US006846280B2

(12) United States Patent
Fukasawa et al.

(10) Patent No.: US 6,846,280 B2
(45) Date of Patent: Jan. 25, 2005

(54) SHEET POST-PROCESSING DEVICE AND IMAGE FORMING APPARATUS HAVING THE SAME

(75) Inventors: Eiji Fukasawa, Yamanashi-ken (JP); Kouki Sato, Ibaraki-ken (JP)

(73) Assignees: NISCA Corporation, Yamanashi-ken (JP); Canon Finetech Inc., Mitsukaido (JP)

( * ) Notice: Subject to any disclaimer, the term of this patent is extended or adjusted under 35 U.S.C. 154(b) by 0 days.

(21) Appl. No.: 10/442,983

(22) Filed: May 22, 2003

(65) Prior Publication Data

US 2004/0105713 A1 Jun. 3, 2004

(30) Foreign Application Priority Data

May 23, 2002 (JP) ..... 2002-148923

(51) Int. Cl.[7] ..... B31F 1/08
(52) U.S. Cl. ..... 493/424; 493/434
(58) Field of Search ..... 493/424, 428, 493/429, 434, 435, 437, 442, 444

(56) References Cited

U.S. PATENT DOCUMENTS 3,901,501 A * 8/1975 Kistner ..... 493/444
4,053,150 A * 10/1977 Lane ..... 493/417
4,569,672 A * 2/1986 Marion et al. ..... 493/359
4,643,705 A * 2/1987 Bober ..... 493/444
4,746,108 A * 5/1988 Hirayama et al. ..... 270/45
4,840,609 A * 6/1989 Jones et al. ..... 493/28
4,909,779 A * 3/1990 Schaffron ..... 493/235
5,092,833 A * 3/1992 King et al. ..... 493/424
5,540,647 A * 7/1996 Weiermann et al. ..... 493/444
6,305,146 B1 * 10/2001 Gerber ..... 53/116

* cited by examiner

*Primary Examiner*—Eugene Kim
(74) *Attorney, Agent, or Firm*—Manabu Kanesaka

(57) ABSTRACT

A sheet post-processing apparatus includes a pair of folding rollers for folding a transported sheet stack by rotation while nipping the sheet stack, a pushing plate for pushing the transported sheet stack into the folding rollers by advancing and retreating relative to the folding rollers, a stack transport upper roller and a stack transport lower roller (first load device) for applying a load to the pushing plate in pushing the sheet stack by contacting the sheet stack at an upstream side of the folding rollers, and sheet holding mechanism (second load device) having a lever for applying a load to the pushing plate in pushing the sheet stack by contacting the sheet stack at the downstream side of the folding rollers. An image forming apparatus is equipped with the sheet post-processing apparatus.

19 Claims, 19 Drawing Sheets

FIG. 13(a)
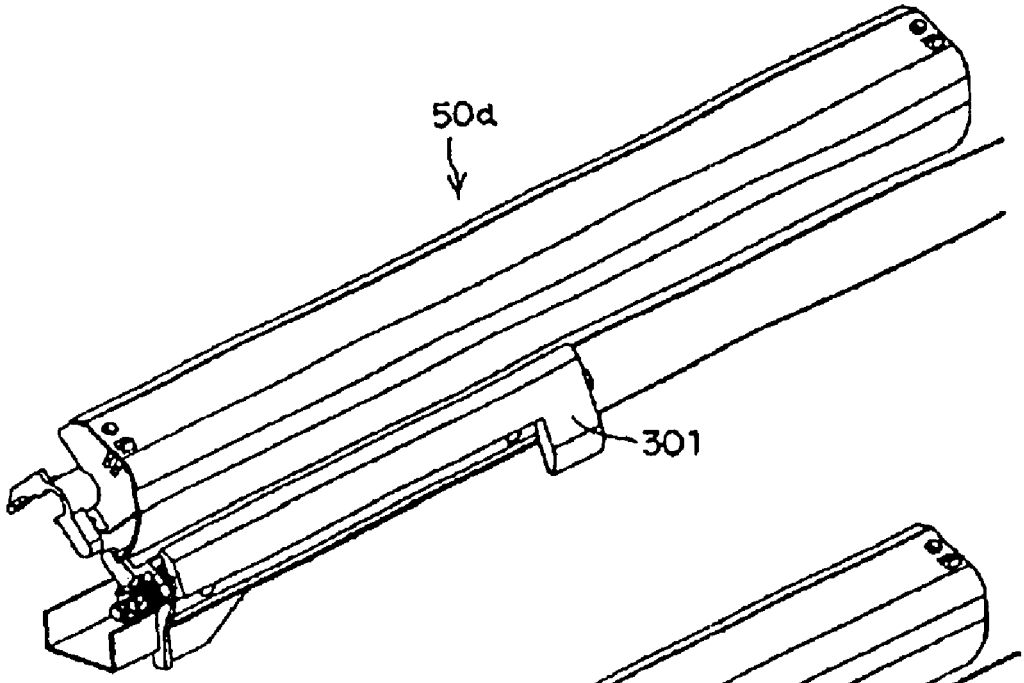
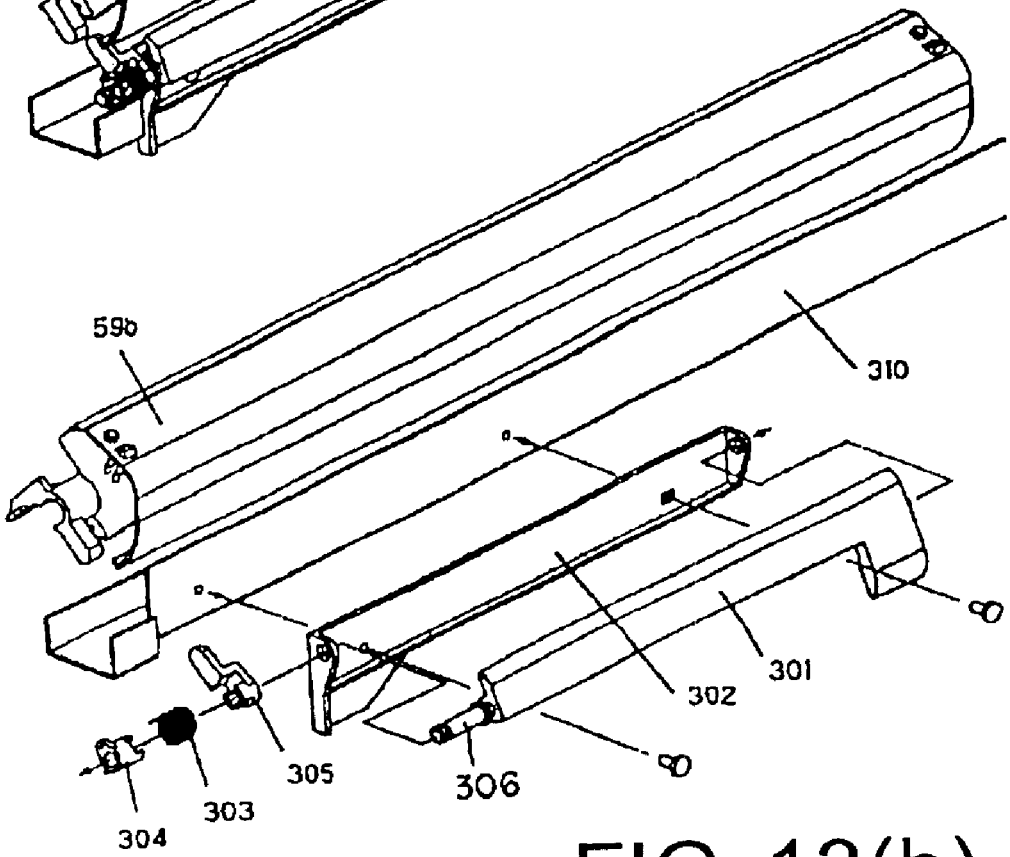
FIG. 13(b)

SHEET POST-PROCESSING DEVICE AND IMAGE FORMING APPARATUS HAVING THE SAME

BACKGROUND OF THE INVENTION AND PRIOR ART STATEMENT

The present invention relates to a sheet post-processing apparatus for folding a stack of sheets and an image forming apparatus equipped with the same.

Conventionally, in an image forming apparatus such as a copier, printer, facsimile machine or machine combined thereof, there is a apparatus provided with a sheet post-processing device for folding a sheet discharged from an image forming apparatus to obtain a finished booklet.

As such a conventional sheet post-processing device, there is a known device provided with a sheet folding mechanism having a plate-shaped pressing member for contacting a sheet along a folding position and a pair of rotating bodies for drawing in the sheet using the plate-shaped pressing member. FIG. 19 shows an example of such a sheet folding mechanism. A stack of sheets to be folded is transported to a folding position by a pair of stack transport rollers (51 and 52), and the stack stays there in a state that the rollers nip an upstream portion of the stack. In this state, the sheet stack is nipped at an upstream side of the pushing plate 55, and hangs downwardly at a downstream side thereof. Next, the pushing plate 55 is pushed toward a surface of the sheet stack, and the pair of the folding rollers (57*a* and 57*b*) rotates to draw in the sheet stack, so that the sheet stack is fold at a folding line. After the folding operation is completed, the nip at the upstream portion of the sheet stack is released to allow the sheet stack to be discharged downwardly.

However, when the pushing plate 55 pushes the sheet stack toward the folding rollers (57*a* and 57*b*), the pushing plate 55 may contact the sheet stack at a position slightly shifted from the folding line. This is because the pair of the stack transport rollers (51 and 52) nips the upstream portion of the sheet stack and the downstream portion of the sheet stack hangs downwardly. Therefore, the downstream portion of the sheet stack is pulled toward an upstream side as the pushing plate 55 pushes the sheet stack. For example, as shown in FIG. 19, when the pushing plate 55 pushes the sheet stack at a predetermined folding point (point A), edges of the sheets at the downstream side are not nipped, and are pulled toward the upstream side, thereby shifting the actual folding point toward (point B). Also, an amount of the shift depends on the number of the sheets and a type of sheet to be folded. Therefore, there is a problem in which it is difficult to accurately fold the sheet stack at a desired folding point.

In view of the aforementioned problem, the present invention has been made, and an object of the present invention is to provide a sheet post-processing apparatus and image forming apparatus equipped with the same in which a sheet stack can be accurately folded at a predetermined folding position.

SUMMARY OF THE INVENTION

To resolve the problem described above, according to the present invention, a sheet post-processing apparatus and image forming apparatus comprise stacking means for stacking at least one sheet; transport means for transporting the sheet from the stacking means; folding rotating bodies for folding the sheet by rotating while nipping the sheet transported from the transport means; a sheet pushing member for pushing the sheet transported by the transport means to the folding rotating bodies by advancing and retreating to and from the folding rotating bodies; first load means for applying a load on the pushing of the sheet member by contacting the sheet at an upstream side of the folding rotating bodies in a transport direction of the transport means; and second load means for applying a load on the pushing of the sheet pushing member by contacting the sheets on the downstream side of the folding rotating bodies in the direction of sheet transport using the transport means.

According to the sheet post-processing apparatus and image forming apparatus of the present invention, when the sheet pushing member (pushing plate) pushes and folds the sheet at the center thereof, the first load means (a pair of stack transport rollers) and the second load means (a lever for holding the sheet or a sheet holding mechanism provided with rollers) apply loads on the upstream and downstream sides of the sheet. When the sheet pushing means pushes the sheet, the folding rotating bodies (folding rollers) nip the sheet in a state that the sheet is pulled toward the upstream and the downstream sides of the sheet with the same tension. Therefore, it is possible to fold the sheet precisely without shifting an actual folding position from the predetermined folding position. Specifically, it is adjusted so that the load applied by the first load means and the load applied by the second load means are equivalent to minimize the shift of the actual folding position.

The sheet post-processing apparatus and image forming apparatus according to the present invention may further comprise support means disposed at least one of the first load means (a pair of stack transport rollers) and the second load means (a sheet holding mechanism), and movable between a contacting position for contacting the sheet and a retracted position away from the sheet. Accordingly, it is possible to precisely adjust the load applied to the sheet by the first load means and the second load means.

In the sheet post-processing apparatus and image forming apparatus according to the present invention, control means may control the support means to move from the retracted position to the contacting position after the transport of the sheet stops, and to move from the contacting position to the retracted position after the folding rotating bodies nip the sheet. Accordingly, it is possible to hold the sheet securely just before the sheet pushing member pushes the sheet so that the folding position does not shift. When the folding rotating bodies nip the sheet, the sheet is pressed with a reduced force to eliminate unnecessary load, thereby making it possible to fold the sheet smoothly.

The sheet post-processing apparatus and image forming apparatus according to the present invention may further comprise interconnecting means for moving the second load means between the contacting position and the retracted position according to the pushing operation of the sheet pushing member, so that the downstream portion of the sheet is held at a proper timing.

The sheet post-processing apparatus and image forming apparatus according to the present invention may further comprise drive means for commonly driving at least two of the folding rotating bodies, the sheet pushing member, the first load means and the second load means, thereby making the drive control simple and reducing a size and cost of the apparatus.

The sheet post-processing apparatus and image forming apparatus according to the present invention may further comprise guide means movable between a closed position for preventing the sheet pushed by the sheet pushing means from moving toward the folding rotating bodies, and an open position for allowing the sheet pushed by the sheet pushing member to move toward the folding rotating bodies according to the operation of pushing the sheet by the sheet pushing member. Also, the second load means is arranged to be movable between the load position and the retracted position according to the movement of the guide member. Accordingly, it is possible to make the apparatus small and reduce a cost.

Note that the drive means may be provided for commonly driving at least two of the folding rotating bodies, the sheet pushing member, the first load means and the second load means, thereby making the drive control simple and reducing a size and cost of the apparatus. Accordingly, it is possible to make the apparatus small and reduce a cost.

In the sheet post-processing apparatus and image forming apparatus of the present invention, the sheet transport means may function as at least one of the first load means and the second load means, thereby making a configuration of the apparatus simple and reducing a cost.

BRIEF DESCRIPTION OF THE DRAWINGS

FIGS. 13(*a*) and 13(*b*) are perspective views of the sheet holding mechanism of the folding unit in the sheet post-processing apparatus, wherein FIG. 13(*a*) shows the completed sheet holding mechanism and FIG. 13(*a*) shows an exploded view of the sheet holding mechanism;

DETAILED DESCRIPTION OF PREFERRED EMBODIMENTS

Figure 18:
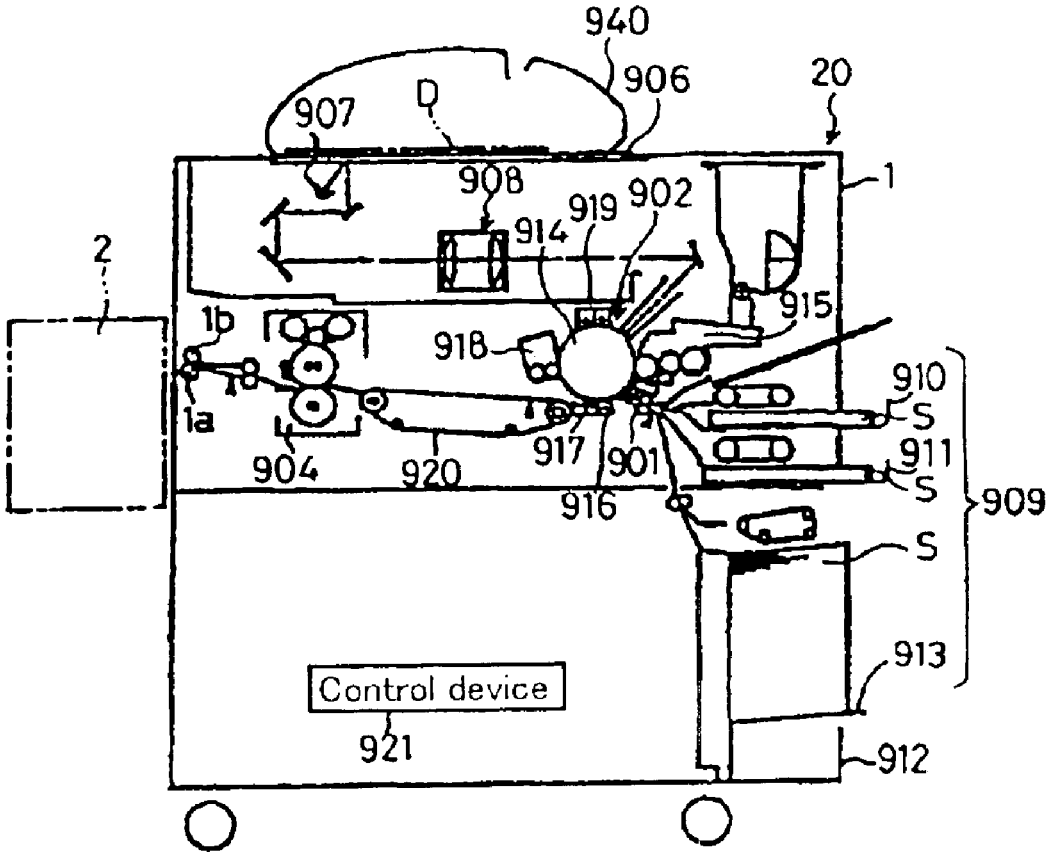
FIG. 18 is a front sectional view of a copier equipped with the sheet post-processing apparatus.
Figure 19:
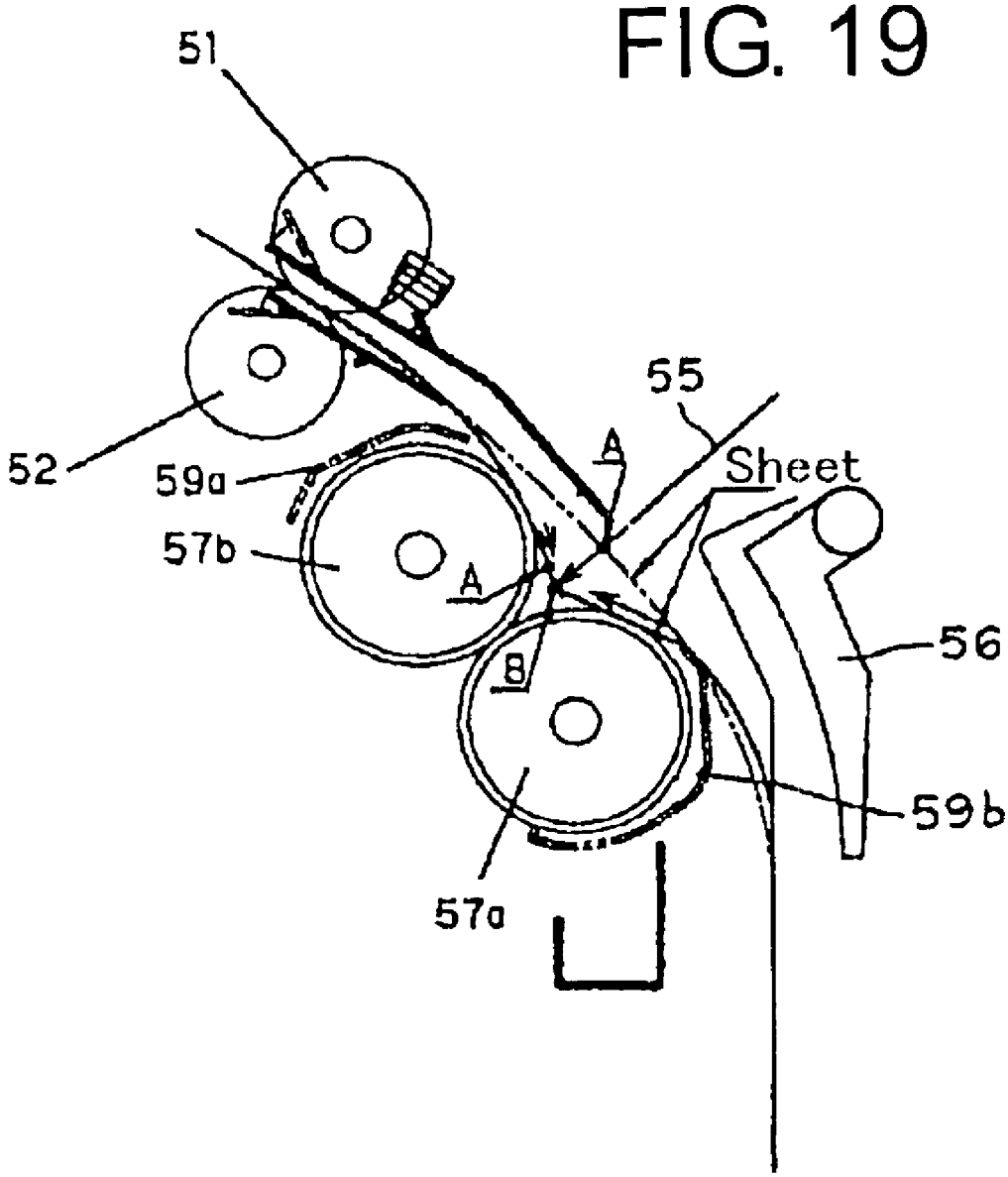
FIG. 19 is a view of a conventional sheet post-processing apparatus.

Hereunder, embodiments of the invention will be explained with reference to the accompanying drawings. A main configuration of a copier will be explained as an example of an image forming apparatus equipped with a sheet post-processing apparatus having a folding unit (sheet post-processing apparatus) for folding a sheet according to the invention with reference to FIG. 18.

A main unit 1 of a copier 20 is provided with a platen 906 as storage means (original tray), light source 907, lens system 908, sheet supply means (sheet feeder 909) and image forming means (image forming unit 902). An original automatic document feeder 940 is disposed at an upper portion of the main unit 1 for automatically feeding a original D to the platen 906.

The sheet feeder 909 comprises cassettes 910 and 911 detachably mounted to the main unit 1 for storing sheets S for recording, and a deck 913 arranged on a pedestal 912. The image forming unit 902 includes a photosensitive drum 914 having a cylindrical shape; a developer 915 arranged around the drum; a charging unit 916 for transfer; a charging unit 917 for separation; a cleaner 918; and a primary charging unit 919. A transport device 920, a fixer device 904 and a pair of discharge rollers (1*a* and 1*b*) are disposed at a downstream side of the image forming unit 902.

An operation of each of mechanisms in the main unit 1 of the copier 20 will be explained next. When a sheet supply signal is output from the control device 912 disposed in the main unit 1, the sheets S are supplied from the cassettes (910 and 911) or the deck 913. The light source 907 irradiates light on the original D placed on the platen 906, and the reflected light irradiates the photosensitive drum 914 through the lens system 908. The photosensitive drum 914 is statically charged in advance by the primary static-charger 919. A static latent image is then formed on the drum by the irradiation of the light. Then, the developer 915 develops the static latent image to form a toner image.

After the sheet S is fed from the sheet feeder 909, the register rollers 901 correct skew of the sheet S and the sheet is fed to an image forming unit 902 at an adjusted timing. In the image forming unit 902, the toner image on the photosensitive drum 914 is transferred to the supplied sheet S by the static-charger 916 for transfer. The charging unit 917 for separation charges the sheet S with the toner image into a polarity opposite to that of the transfer unit 916, so that the sheet is separated from the photoconductive drum 914.

The separated sheet S is transported to the fixer device 904 by the transport device 920, where the transferred image is permanently fixed to the sheet S by the fixer device 904. Then, the sheet S with the fixed image is discharged outside of the main unit 1 by the discharge rollers (1*a* and 1*b*).

In this way, the image is formed on the sheet S fed from the sheet feeder 909, and the sheet S with the image is discharged into the sheet post-processing device 2.

Figure 1:
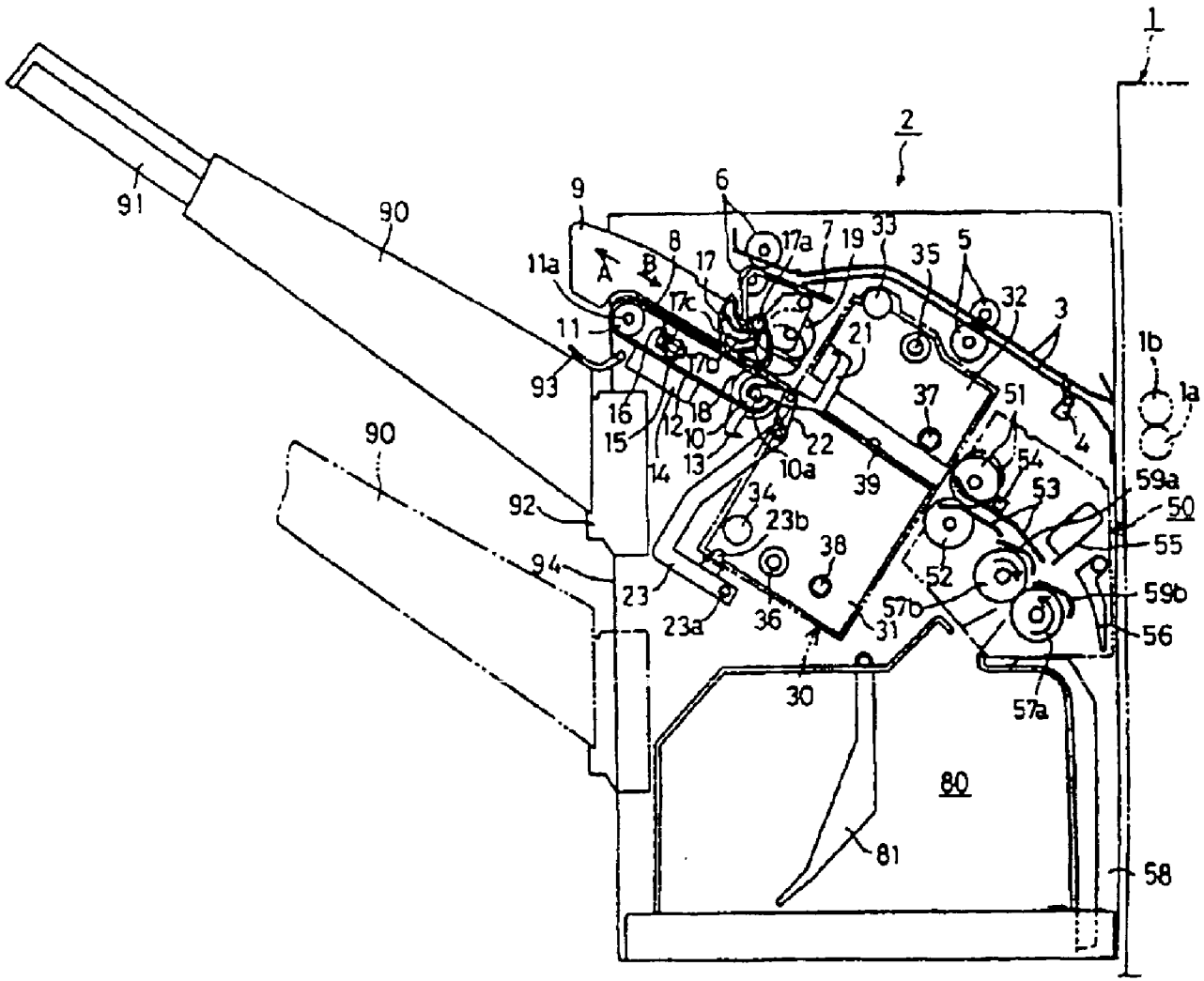
FIG. 1 is a front sectional view of an image forming apparatus provided with a sheet post-processing apparatus of the present invention.

FIG. 1 shows the sheet post-processing apparatus 2 (also called a finisher) disposed at a side of the main unit 1 of the copier. A pair of discharge rollers is formed of a discharge roller 1*a* and a discharge roller 1*b* pressing against the discharge roller 1*a*, and is disposed in the main unit 1 of the copier 20. A pair of transport guides 3 receives a sheet discharged from the discharge rollers (1*a* and 1*b*) in the copier 20, and guides the sheet into the sheet post-processing apparatus 2. The sheet sensor 4 detects the sheet transported into the transport guide 3. The sheet sensor 4 functions to determine alignment timing, and to determine whether the sheet is jammed in the transport guide 3 by detecting the sheet. The pair of discharge rollers 6 rotates to nip the sheet in the transport guide 3 to transport the sheet.

Figure 2:
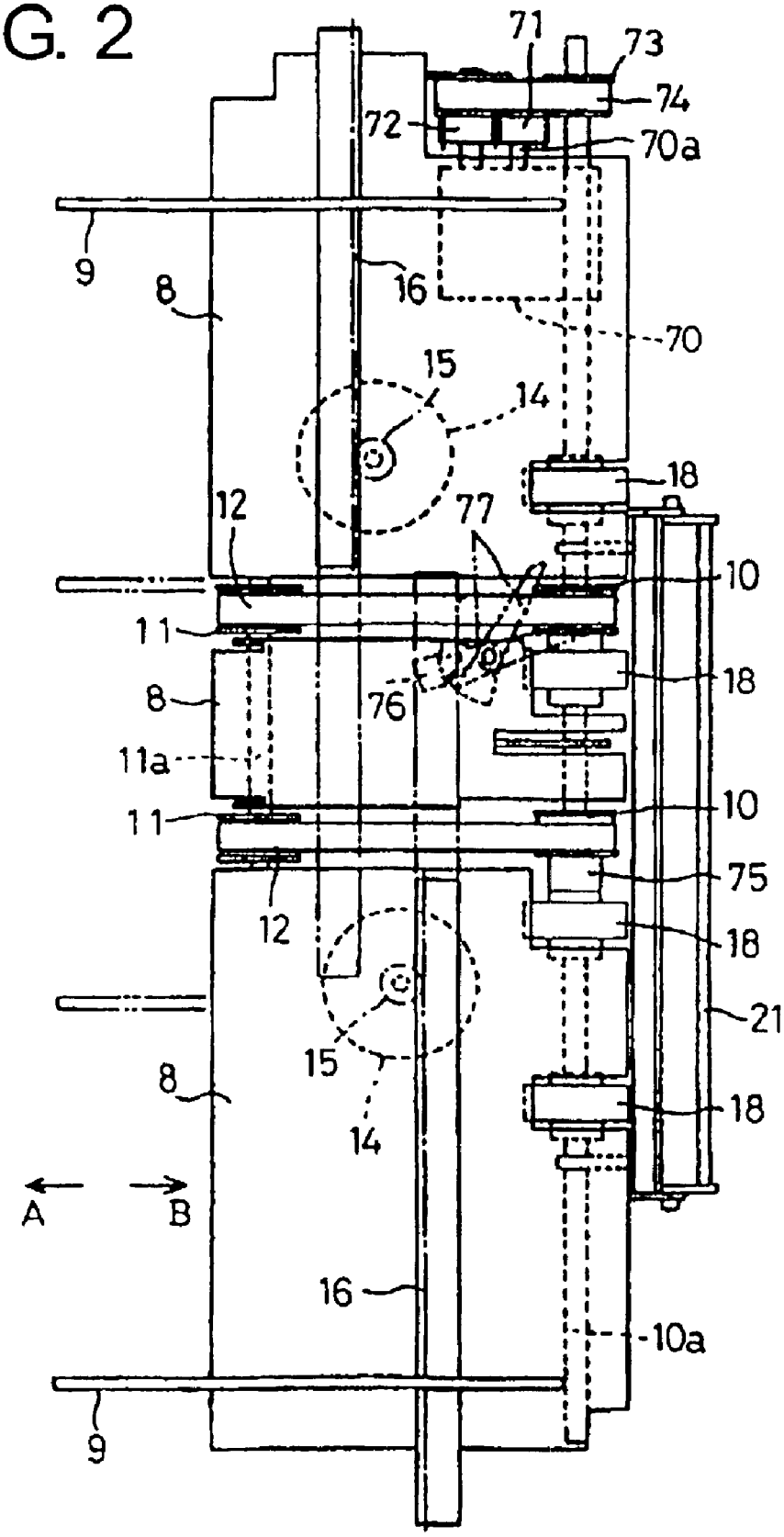
FIG. 2 is a view showing a processing tray of the sheet post-processing apparatus of the present invention seen from above.

The stacking means (process tray 8) receives sheets sequentially discharged by the pair of discharge rollers 6, and stacks the sheets. The process tray 8 has a pair of alignment plates 9 for guiding both sides of the sheet discharged by the pair of discharge rollers 6 to align the sheets in a width direction. The alignment plates 9 are arranged on both sides of the sheet in the width direction to traverse the direction of sheet transport, as shown in FIG. 2. Each alignment plate 9 comprises a rack 16 unitized therewith for mating the pinion 15 disposed on the shaft of the alignment motor composed of a stepping motor arranged below the process tray 8. The alignment plates 9 are mounted to the process tray to move in the width direction of the sheets by rotating the alignment motor 14 on the front side and the alignment motor 14 on the back side.

In FIG. 1, the transfer in guide 7 guides the sheets discharged from the pair of discharge rollers 6 to the process tray 8. Below the transfer in guide 7 is disposed the paddle 17. The paddle 17 is formed in a semi-circular shape made of a rubber material having a constant elasticity to securely transfer the sheet. The paddle 17 contacts the top surface of the sheet and rotates around the shaft 17*a*. Also, the paddle 17 is formed in a unitized body with the fan 17*b* extending in radial directions and the paddle surface 17*c* around the shaft 17*a*. As the sheets S are stacked on the process tray 8, the paddle 17 is easily deformed, thereby providing an appropriate transport force to the sheets S.

The process tray 8 is provided at the left and right sides with the first pulley 10 disposed on the first pulley shaft 10*a*, as shown in FIG. 1, and the second pulley 11 disposed on the second pulley shaft 11*a*. The transport belt 12 is trained between the first pulley 10 and the second pulley 11. A pushing nail 13 protrudes from a portion of an outer surface of the transport belt 12.

The transport lower rollers 18 are coaxially disposed on the first pulley shaft 10*a*. The transport top roller 19 is disposed above the transport lower roller 18 to move between a position that contacts the transport lower roller 18 (a position indicated by hidden line in FIG. 1) and a position separated from the transport lower roller 18 (a position indicated by solid line in FIG. 1).

When the sheet is discharged to the process tray by the pair of discharge rollers 6, falls downwardly by its own weight, and moves with the rotation of the paddle 17, the stopper 21 receives the edge of the sheet to control. One side of the stopper 12 is supported by the first pulley shaft 10*a*, and is constantly urged toward a position that regulates the edge of the sheets by a spring or the like (not shown).

The stapler unit 30 is configured as a unit as shown by phantom line in FIG. 1, and can be pulled out of the sheet post-processing apparatus 2. The stapler unit 30 comprises the staple driving head unit 31 having a staple cartridge (not shown) at a lower side with the transport path in between, and an anvil unit 33 at an upper side for bending staples driven from the staple driving head unit 31. The staple driving head unit 31 and the anvil unit 33 can move in a direction (back to front direction of the sheet surface) perpendicular to the sheet transport direction (from right to left in FIG. 1). The guide rods (33 and 34) are disposed vertically for guiding the anvil unit 32 and the drive head unit 31 to move in a direction perpendicular to the sheet transport direction (shift movement). The screw shafts (35 and 36) perform the shifting movement of the anvil unit 32 and the drive head unit 31. Also, the anvil drive shaft 37 and head drive shaft 38 are the drive shafts for the staple driving action and staple bending action of the anvil unit 32 and drive head unit 31. The transport guide 39 guides the supplied sheet stacks into the stapler unit 30.

The sheet stack folding unit 50 is unitized, as shown by hidden line in FIG. 1. In the same way as the stapler unit 30, the sheet stack folding unit 50 can be pulled out of the sheet post-processing apparatus 2. A sheet stack transport guide 53 guides the sheet stack nipped and transported by the transport upper roller 19 and transport lower roller 18 positioned at the inlet side of the stapler unit 30. A stack transport roller 51 is disposed on the inlet side of the folding unit 50. A stack transport unit roller 52 is arranged at a side opposite to the stack transport roller 51. The stack transport upper roller 51 moves between a position where it presses against the stack transport lower roller 52 (the position shown as the solid line in FIG. 1) and a separated position (the position shown as hidden line in FIG. 1). Also, the stack transport upper roller 51 is separated from the stack transport lower roller 52 until the leading edge of the sheet stack being fed by the transport upper roller 19 and the transport lower roller 18 passes through the stack transport upper roller 51 and the stack transport lower roller 52 (the position shown as projected line in FIG. 1). Then, the stack transport upper roller 51 moves to a position where it is in contact with the stack transport lower roller 52 (the position shown as solid line in FIG. 1).

When the stack sensor 54 detects the leading edge of the sheet stack, the stack transport upper roller 51 moves to press against the stack transport lower roller 52 and is used for controlling the folding position of the sheet stack in the transport direction. The pushing plate 55 is formed of stainless steel, and has an edge with a thickness of 0.25 mm. The pair of folding rollers (57*a* and 57*b*), i.e. the sheet folding rotating bodies, is formed in a cylindrical shape extending in the direction perpendicular to the sheet stack transport direction. The folding rollers rotate while being urged in a direction whereat they press against each other.

A diameter of the folding rollers (57*a* and 57*b*) is approximately 40 mm. A circumference length of the rollers is shorter than a length of the folded sheet stack. Therefore, the rollers rotate at least one rotation to transport the folded sheet stack. Since the rollers have the circumference length shorter than the length of the folded sheet stack, it is possible to make the folding unit 50 compact.

The pushing plate 55 is positioned substantially directly above the folding rollers (57*a* and 57*b*). A leading edge of the pushing plate 55 reciprocally and intermittently moves near the nipping position of the folding rollers (57*a* and 57*b*) via the Geneva mechanism (described below) through the rotation of the drive motor. The pushing plate 55 and the folding rollers (57*a* and 57*b*) are interconnected to the Geneva mechanism (described below) so that the pushing plate 55 moves at a speed approximately 2.2 times faster than that of the sheet transport. The time required for folding the sheet stack at the central location to move to the nipping position of the folding rollers (57*a* and 57*b*) is substantially the same as the time required for moving the pushing plate to the nipping position of the folding rollers (57*a* and 57*b*) after contacting the folding position of the sheet stack. The folding rollers (57*a* and 57*b*) are synchronized for operation. The pushing plate 55 is mechanically set so not as to contact both edges of the folded sheet stack after the pushing plate pushes twice.

The time for moving the folding portion of the sheet stack to the nipping position of the folding rollers (57*a* and 57*b*) is the same as the time for moving the pushing plate 55 from the contact point on the folding portion of the sheet stack to the nipping position of the folding rollers (57*a* and 57*b*). In other words, as shown in FIG. 17, when a length (EG) between a contact position (E) of the folding roller 57*b* contacting an unfolded, straight sheet and a center of the sheet (G), which is equal to a diameter of the folding roller 57*b*, is taken as the arc EG1 on the circumference of the folding roller 57*b*, the time required (T1) for moving the pushing plate for an amount GF when the folding rollers (57*a* and 57*b*) contact the sheet pushed by the pushing plate 55 is equal to the time (T2) required for rotating the folding rollers 57*b* for a length of the arc (G1F) of the folding rollers 57*b* (T1=T2).

Figure 17:
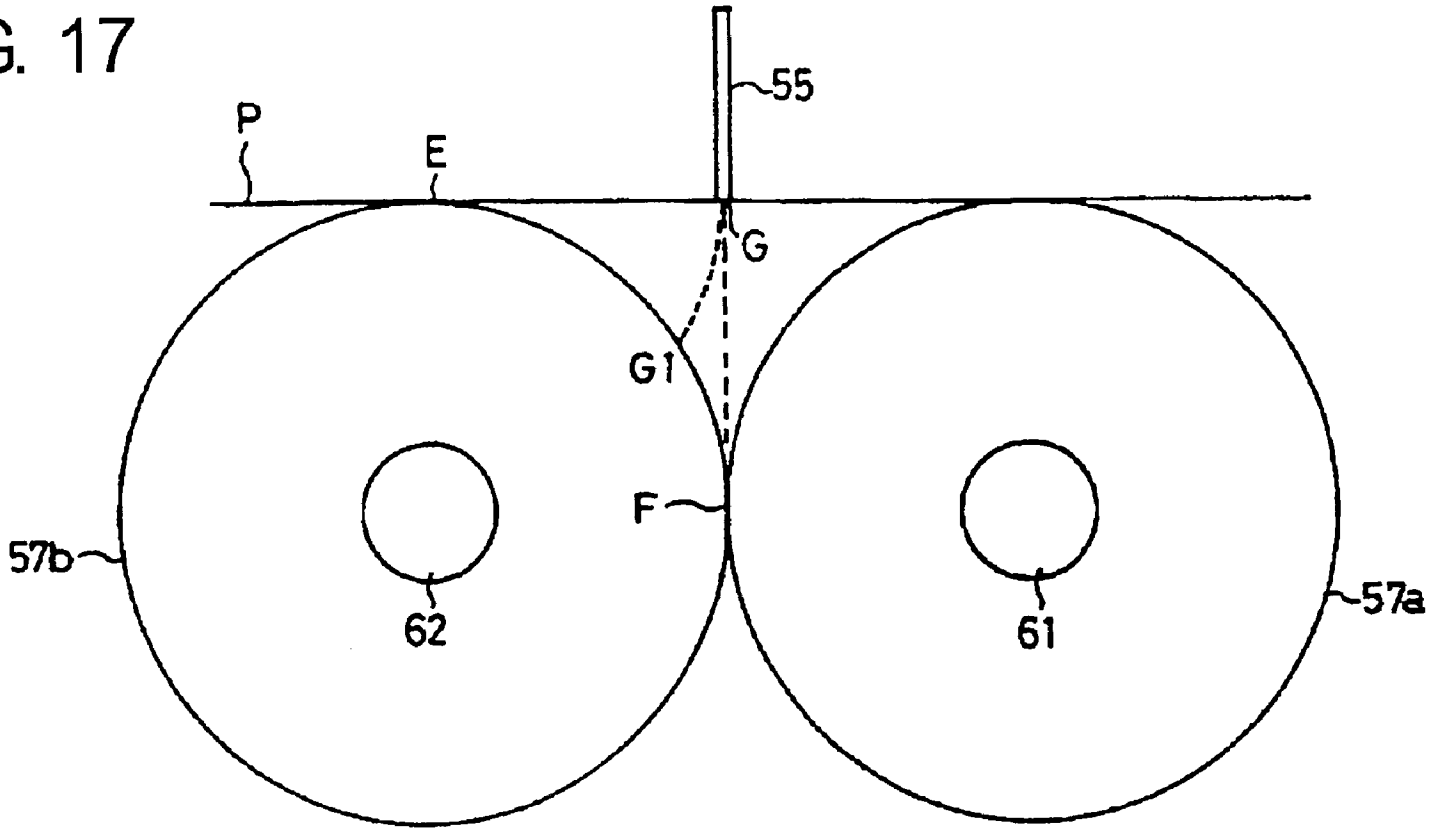
FIG. 17 is a view explaining moving time of a folding roller and the pushing plate of the folding unit in the sheet post-processing apparatus.

As shown in FIG. 17, the time T1 is equal to the time T2, and the pushing plate 55 moves at a speed approximately 2.2 times faster than that of the folding rollers (57*a* and 57*b*). As a result, so even if the distance (GF) is shorter than the length of the arc (G1F), the leading edge of the pushing plate 55 reaches the nipping position of the folding rollers (57*a* and 57*b*) at the same time when the position (G1) above the folding rollers 57*b* reaches the nipping position (F) of the folding rollers (57*a* and 57*b*). Therefore, the pushing plate 55 sends the sheet into the nipping position (F) without loosening or tearing the sheet.

Backup guides 59*a* and 59*b* having substantially arched shapes are disposed above the folding rollers 57*a* and 57*b* to assist the transport guide 53 to guide the sheet stack. The backup guides 59*a* and 59*b* are interconnected to the up and down movement of the pushing plate 55. When the leading edge of the pushing plate 55 moves close to the nip between the folding rollers 57*a* and 75*b*, the backup guides 59*a* and 59*b* move to open the circumferences of the folding rollers 57*a* and 57*b* relative to the sheet stack. The sheet stack guide 56 guides the sheet stack transported and sandwiched between the stack transport upper roller 51 and the stack transport lower roller 52 to the bottom side. The leading edge of the sheet stack (the downstream edge) hangs downward into the sheet stack path 58.

The discharge stacker 80 stacks the folded sheet stack after the sheet stacks are folded with the folding rollers (57*a* and 57*b*) and discharged. The folded sheet holder 81 holds the sheet stacks discharged to the stack discharge stacker 80 using a spring or their own weight. The sheet stack path 58 is formed in a space between the sheet post-processing apparatus 2 frame and the stack discharge stacker 80 for allowing the sheet stack to move.

The lifting tray 90 ascends and descends in the vertical direction along the sheet post-processing apparatus 2 frame, and moves between the position shown as solid line and the position shown as hidden line in FIG. 1. The lifting tray 90 abuts a part of a belt rotating with the drive means of a lifting tray motor 155 (see FIG. 16 ) to raise and lower a lifting tray support 92. A paper surface sensor 93 detects the uppermost surface of sheets on the lifting tray 90. The trailing edge guide 94 guides the trailing edges of sheets on the lifting tray 90 that rises and lowers to move in the vertical direction. The auxiliary tray 91 is disposed in the lifting tray 90 and is pulled out for use when large sized sheets are stacked.

A configuration of each of the process tray 8 on the sheet post-processing apparatus 2 and the folding unit 50 of the stapler unit 30 will be explained with reference to FIG. 2 and the following drawings. FIG. 2 is a plan view of the process tray 8. Transport belts 12 are trained between the first pulley 10 and the second pulley 11, and are positioned on both sides of substantially the center in the sheet width direction. The transport lower rollers 18 are disposed at two locations on both sides of the first pulley shaft 10*a* at substantially the center in the sheet width direction. The transport lower rollers 18 are hollow rollers of tire type.

To the first pulley shaft 10*a* are arranged two first pulleys 10 for rotating the transport belts 12, as described above. As shown in FIG. 1, the first pulley shaft 10*a* rotates in the counterclockwise direction to drive the first pulley 10, and rotates in the clockwise direction to be cut through the one-way clutch 75 disposed between the first pulley 10 and the first pulley shaft 10*a*. The first pulley shaft 10*a* is interconnected to the stepping motor 70 motor shaft 70*a* via the pulley 73 mounted on the first pulley shaft 10*a*, the timing belt 74 and the gear pulleys 72 and 71.

Therefore, when the stepping motor rotates in a direction that moves the sheets on the process tray 8 in the stapling direction in FIG. 1 (the direction of the arrow B in FIG. 1 and FIG. 2), the transport lower roller 18 mounted on the first pulley shaft 10*a* rotates, and no drive force is transmitted to the transport belts 12 due to the one-way clutch 75, so that the transport belts 12 are stopped. When the stepping motor 70 rotates in the direction to move the sheets in the lifting tray 90 direction, the transport lower roller 18 and transport belts 12 also rotate in the direction of the lifting tray 90 (the direction of the arrow A in FIG. 1 and FIG. 2).

Figure 3:
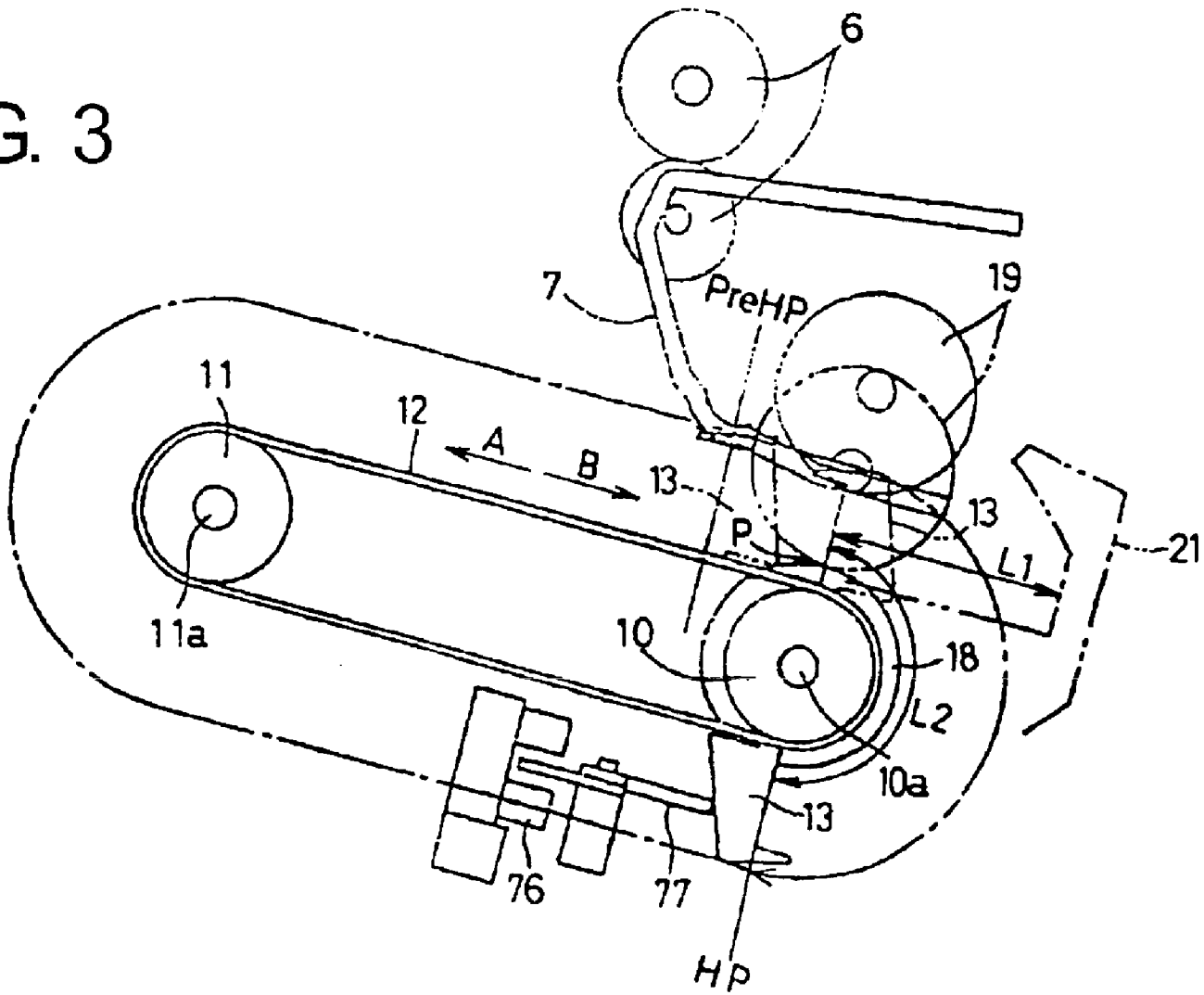
FIG. 3 is an enlarged view of a transport belt in the sheet post-processing apparatus.

The transport belts 12 will be explained with reference to FIG. 3. Pushing nails 13 are disposed on the transport belts 12 trained between the first pulley 10 connected to the first pulley shaft 10*a* through the one-way clutch 75 and the second pulley 11. To establish the home position of the pushing nails 13 (HP position in FIG. 3), a pushing nail sensor 76 of the pushing nail 13 that abuts the pushing nail 13 and the pushing nail detection arm 77 are disposed on a lower surface of the process tray 8. The pushing nail 13 is moved by the transport belt 12 and pushes the pushing nail detection arm 77. The pushing nail sensor 76 switches from off to on at the home position (HP). This positional relationship is shown in FIG. 3. When the nip point between the transport lower roller 18 and the transport upper roller 19 is set to be P, it is arranged that a length L1 from the nip P to the stopper 21 is shorter than a length L2 from the nip P to the pushing nail 13 along the transport belts 12.

A cam, not shown in the drawings, rotates to lower the transport upper roller 19 to press against the transport lower roller 18. Then, the transport stepping motor 70 is rotated. When the first pulley rotating shaft 10*a* is rotated in the counterclockwise direction (the direction of the arrow A in FIG. 1 and FIG. 2), the transport lower roller 18 rotates to move the sheet stack in the direction of the lifting tray 90 (the direction of the arrow A).

Note that the transport upper roller 19 is also configured to rotate by the stepping motor 70 (see FIG. 2). Therefore, the sheet stack moves from the position of the stopper pulled into the stapler unit 30 side in the direction of the arrow A by the rotation of the transport lower roller 18 and the transport upper roller 19. When the sheet stack passes the nipping position P, the pushing nails 13 contact the sheet stack through the rotation of the transport belts 12, and transport the sheet stack to the lifting tray 90 in the direction of the arrow A in the drawings. Because L1 is shorter than L2 as described above, the pushing nails 13 constantly push the sheet stack edge vertically while pushing from the bottom side of the sheet stack (the right edge side shown in FIG. 3). This prevents any excess stress from occurring on the sheet stack as it is being sent.

When performing the binding operation, the pushing nail 13 moves from the position of the HP in FIG. 3 in the counterclockwise direction, at the same time, it pushes the sheet stack after handing it over, by moving the stopper 21 through the pair of rollers (18 and 19) that transport the sheet stack.

When not performing the binding process on the sheets transported into the process tray 8, using the stapler unit 30, it is not necessary to transfer the sheet stack all the way to the stopper 21 position, so the transport stepping motor 70 drives in advance to move the pushing nail 13 from the HP position of FIG. 3 to an idling position (an idling position corresponding to L2+α, the Pre-HP position in FIG. 3) in the direction of the lifting tray 90 further from the nip of the transport lower roller 18 and the transport upper roller 19. This amount (L2+α) can be set as a stepping count on the stepping motor 70. Therefore, the sheet post-processing apparatus 2 can move the pushing nails to the Pre-HP position in advance without moving the sheets to the stopper 21 and stack the sheets before pushing the stack to the lifting tray 90, when there are sheets that do not require the binding process, so this can handle a copier apparatus with a high processing speed.

Note that when the Pre-HP position of the pushing nail 13 is a position where a transfer in guide 7 and the upper edge of the pushing nail 13 overlap, as can be seen in FIG. 3, the sheets fed sequentially can be securely stacked at the pushing nail 13 position in the Pre-HP position. In this way, the pushing nails 13 can later quickly discharge the sheet stack to the lifting tray 90.

Figure 4:
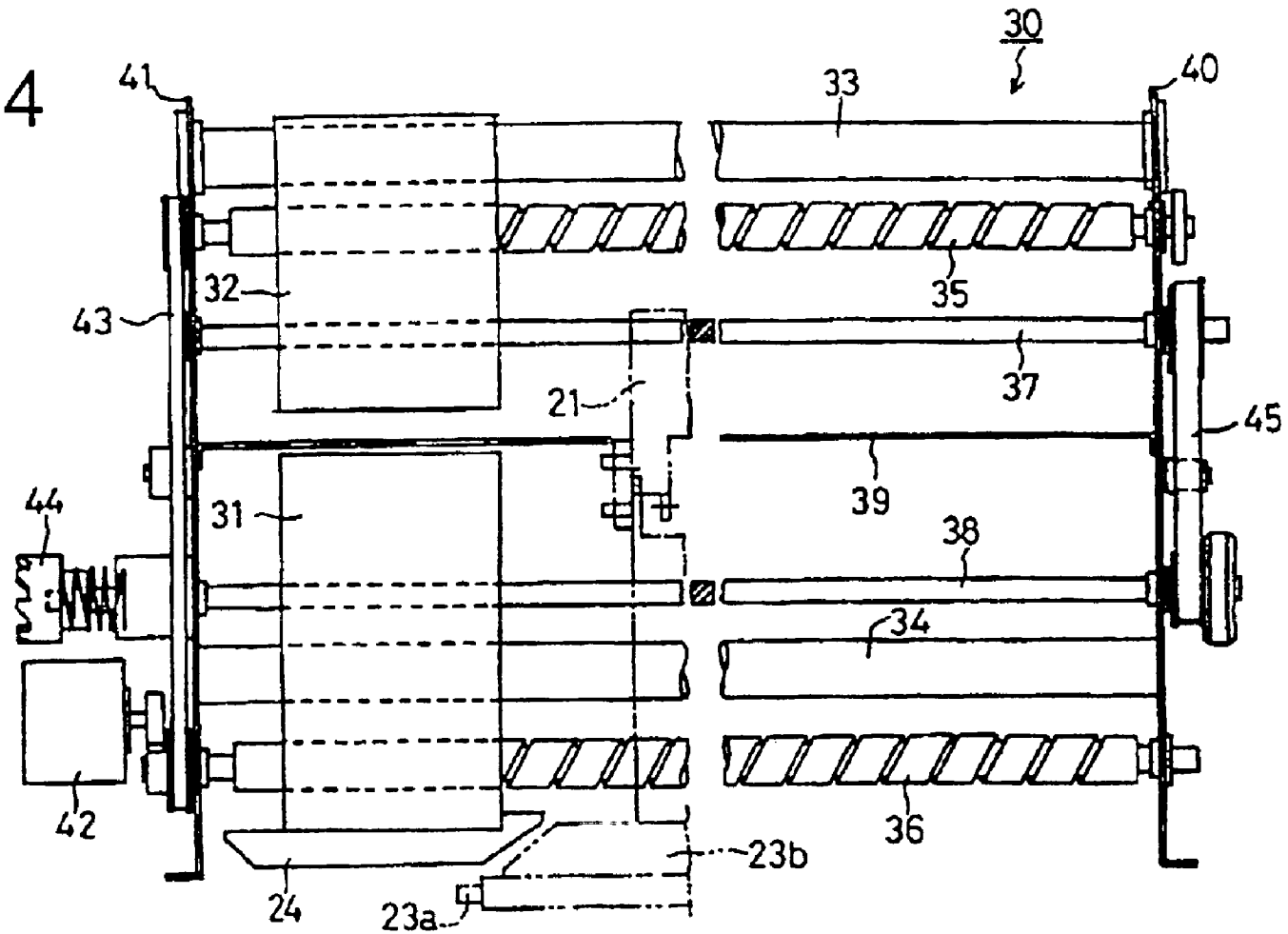
FIG. 4 is a view showing a stapler unit in the sheet post-processing apparatus of the present invention seen from a sheet transport direction.
Figure 5:
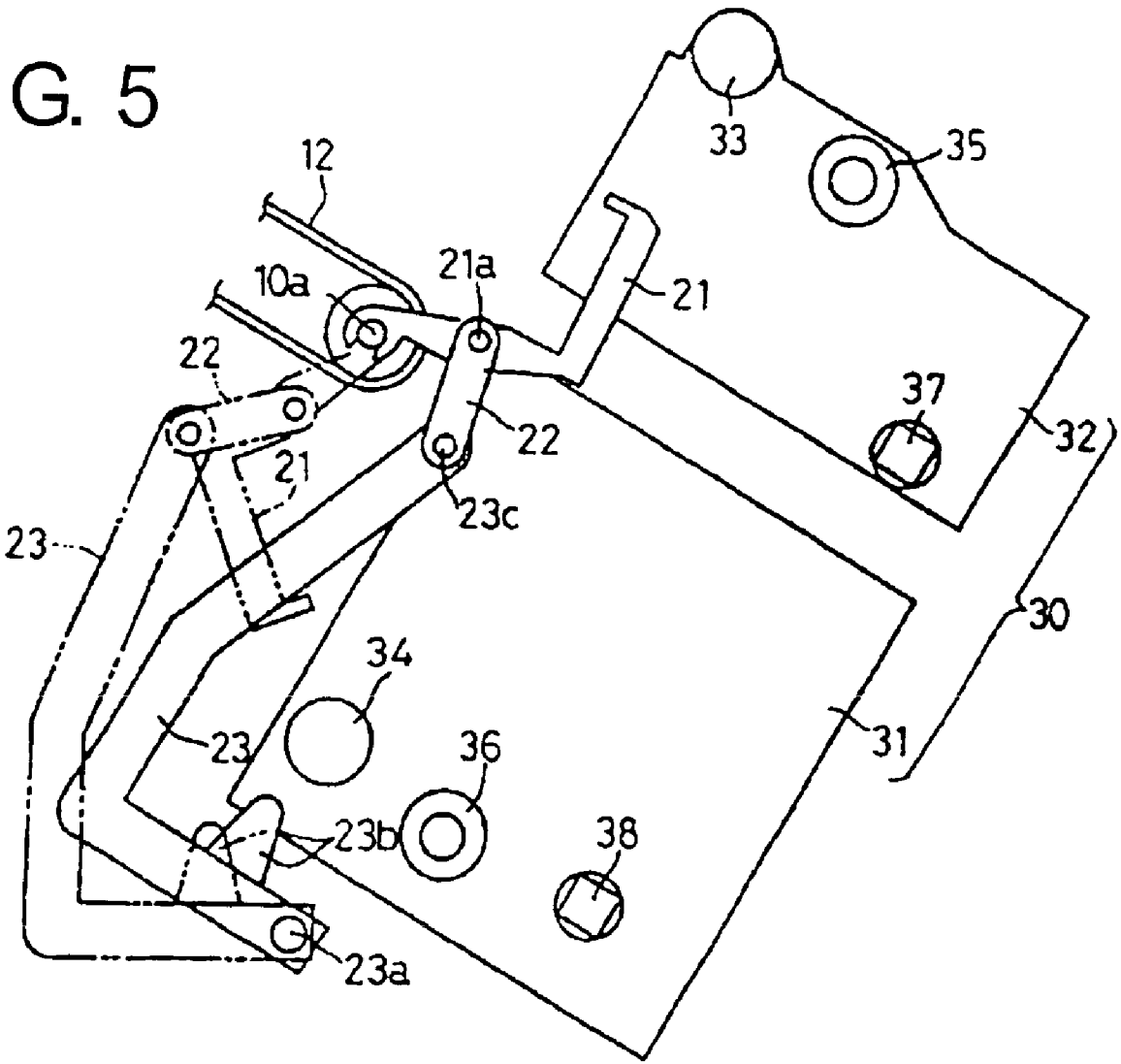
FIG. 5 is an explanatory view of an operation of a stopper of the sheet post-processing apparatus.

In FIG. 4 and FIG. 5, the stapler unit 30 comprises the left and right unit frames (40 and 41), the guide rods (33 and 34) disposed between the frames (40 and 41), the screw shafts (35 and 36), the drive shafts (37 and 38), the anvil unit 32 above, and the drive head unit 31 below. The drive head unit 31 abuts the screw shaft 36. The head unit 31 is able to move in the left and right directions of FIG. 4 through the rotation of the screw shaft 36. The anvil unit 32 has the same mounting configuration. The screw shaft 36 is interconnected to the stapler slide motor 42 via a gear outside of the unit frame 41. The drive of the stapler slide motor 42 is also transmitted to the anvil unit 32 by the timing belt feed roller 43. For that reason, the head unit 31 and anvil unit 32 move in a direction that traverses the sheet transport direction (in the left and right directions of FIG. 4) without any positional discrepancy in the up or down directions.

Therefore, it is possible to freely drive staples into any position on the sheet stack by controlling the head unit 31 and the anvil unit 32 to move to a predetermined position by driving the staple slide motor 42.

Also, the drive force for moving the head to drive staples (not shown in the drawings) in the staple unit 31, and the staples and for bending the staples in the anvil unit 32 is configured to be received from the sheet post-processing apparatus 2 side at the coupling apparatus 44. It is also transmitted to the anvil unit 32 by the timing belt supply roller 45 on the unit frame 40. The movement arm 23 (see FIG. 5) and the stopper 21 are interconnected by the interlock pin 23*c*, the interlock lever 22 and the interlock pin 21*a*. The stopper 21 is supported by the pulley shaft 10*a*.

The following will describes a mechanism of moving the stopper 21 in the staple path for setting the staple driving position on the sheet stack edge, by the movement of the head unit 31 in the sheet width direction, based on FIG. 4 and FIG. 5. Below the drive head unit 31 in FIG. 4 is disposed the stopper abutting protrusion 24 that can abut the stopper 21 with the movement arm 23. The movement of the head unit 31 abuts the stopper abutting protrusion 24 against the movement arm protrusion 23*b*. As can be seen in FIG. 5, the movement arm 23 rotates in the counterclockwise direction around the rotating cam 23*a* to move to a position indicated by phantom line. Therefore, the stopper 21 is not hindered by anything in the movement of the head unit 31 and the anvil unit 32 in the sheet width direction.

Figure 6:
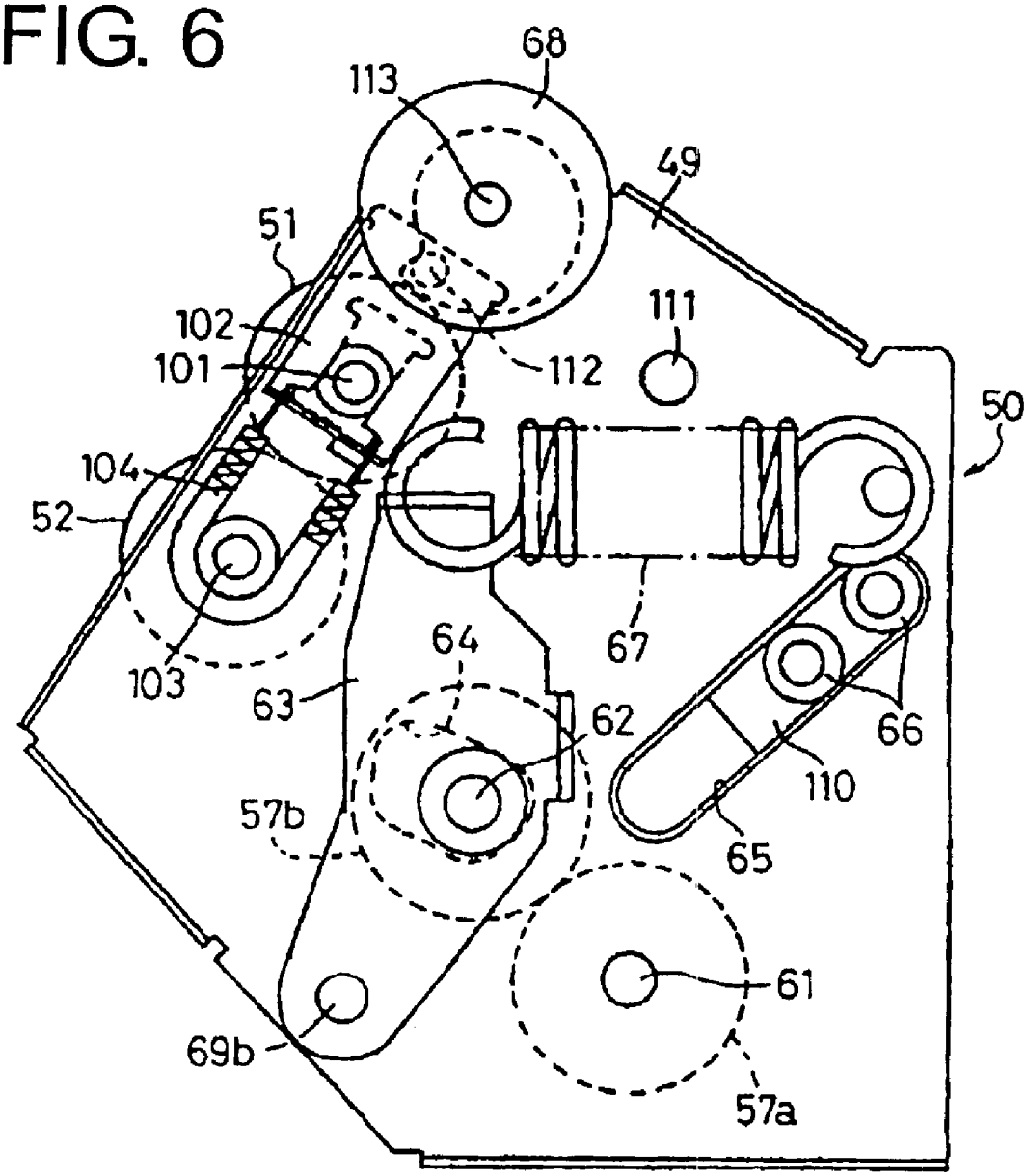
FIG. 6 is a front view of a folding unit frame in the sheet post-processing apparatus.
Figure 15:
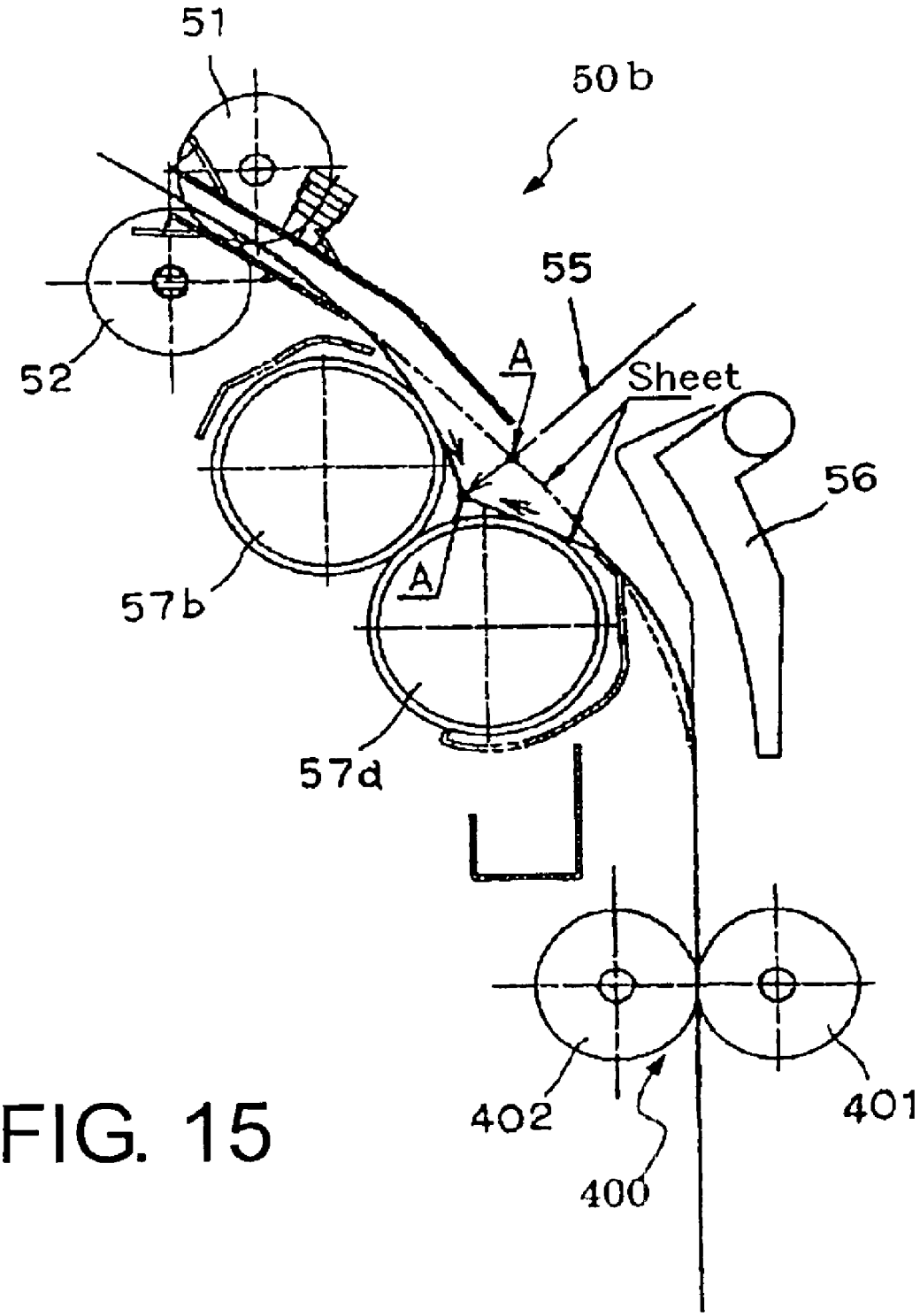
FIG. 15 is a view of a sheet holding mechanism of a folding unit in a sheet post-processing apparatus according to the second embodiment.

The following describes the folding unit 50 in relation to FIG. 6 and FIG. 15. FIG. 6 a view showing the folding unit frame 49 of the folding unit (sheet post-processing apparatus) 50. Because the folding unit 50 is detachably disposed to the sheet post-processing apparatus 2, the shape of the frame at the backside of FIG. 6 has the same form. To the folding unit frame 49 of the folding unit 50 is disposed a folding roller drive shaft 61 as the rotating shaft for the folding roller 57*a*. The drive shaft 62 for the other folding roller 57*b* is mounted to the folding roller holder 63 that rotates around the shaft 69*b*. Between the folding roller holder 63 and the folding unit frame 49 is stretched the tension spring 67 with a pulling force of approximately 5 kg. The folding unit frame 49 has a hole, i.e. the frame guide 64, for allowing the folding roller drive shaft 62 to move through the folding roller holder 63.

Therefore, when the folding rollers (57*a* and 57*b*) fold and transport the sheet stack, it is possible to apply a constant pressure on the sheet stack using the tension spring 67 to enable the sure folding operation.

A pushing plate frame guide 65 is formed in an elongated hole in the folding unit frame 49 for guiding the rollers 66 disposed on the support holder 110 for supporting the pushing plate 55. The pushing plate 55 can move toward the folding rollers (57*a* and 57*b*) with the pushing plate frame guide 65. To the folding unit frame 49 is disposed the drive shaft 111 for supporting the cam plate 114 that moves the pushing plate 55.

Also to the folding unit frame 49 are provided the support means (upper roller shaft 101) of the stack transport upper roller 51 and the support means (lower roller shaft 103) of the stack transport lower roller 52 for transporting the sheet stack into the folding unit 50. To the folding unit frame 49 is arranged a mechanism for positioning the stack transport upper roller 51 at a position separated from the stack transport lower roller 52 until the sheet stack is transferred into the folding unit 50.

The upper roller shaft 101 of the pair of stack transport rollers (51 and 52) is supported on the bearing holder 102. To a side of the bearing holder 102 is disposed the cam follower 112. The cam follower 112 abuts against the upper roller movement cam 68 rotatably mounted to the folding unit frame 49. A tension spring 104 having a tension of approximately 300 g is stretched between the other side of the bearing 102 and the lower roller shaft 103. The tension spring 104 constantly urges the stack transport upper roller 51 to the stack transport lower roller 52 side. The bearing holder 102 rises and lowers against the tension spring 104 in a pulled state to move the stack transport upper roller 51 to a position where it is separated from the stack transport lower roller 52 and where it presses against it, by the rotation of the upper roller movement cam 68.

Figure 7B:
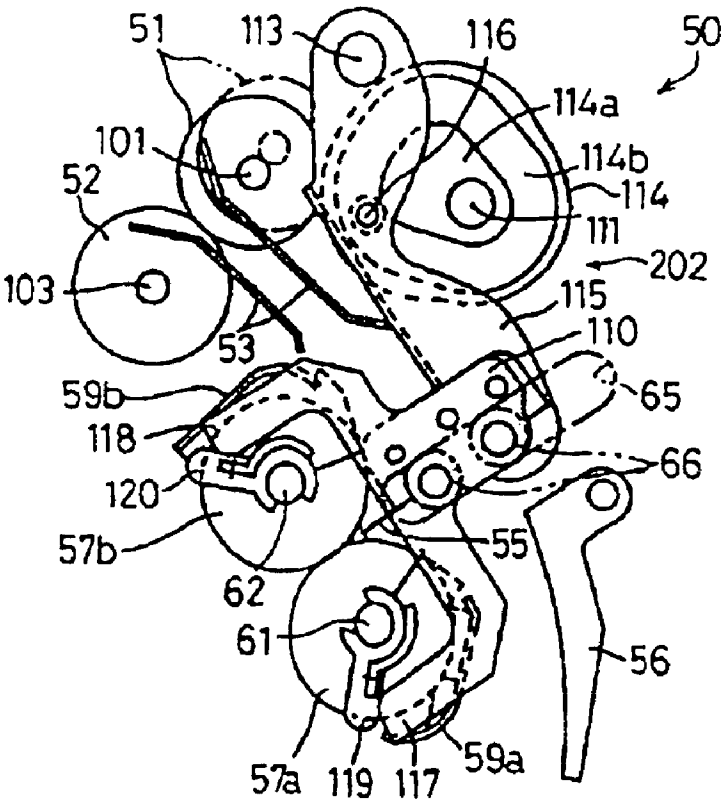
FIGS. 7(*a*) and 7(*b*) are explanatory views showing an operation of the folding unit in the sheet post-processing apparatus, wherein FIG. 7(*a*) shows a state before the folding unit folds a sheet and FIG. 7(*b*) shows a state that the folding unit folds the sheet.
Figure 7A:
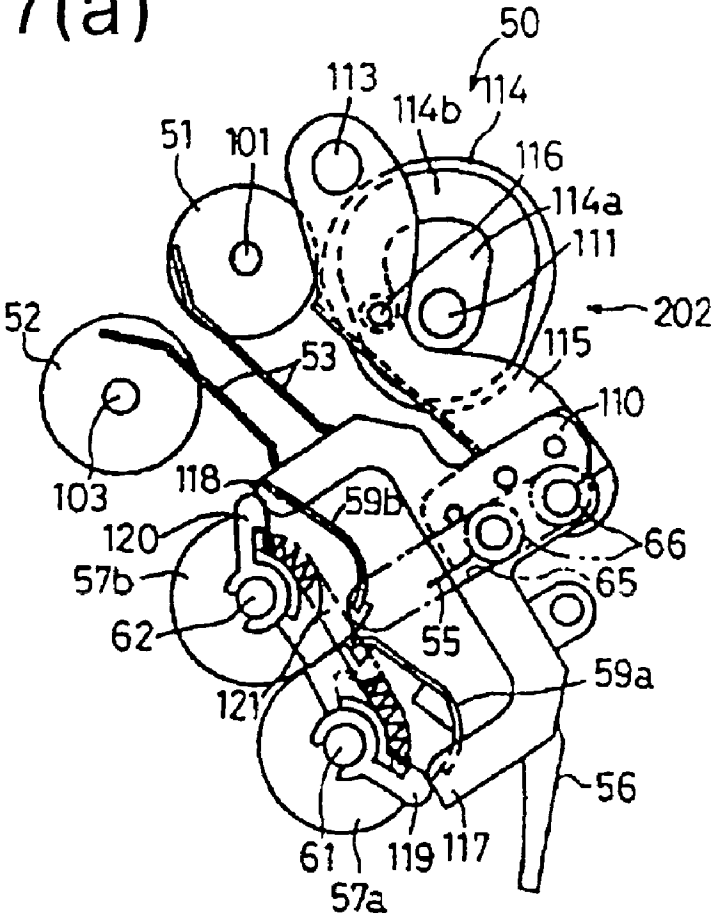

FIGS. 7(*a*) and 7(*b*) show a mechanism for performing the folding operation. The mechanism is disposed at the inside of the folding unit frame 49 shown in FIG. 6. The rotating shaft 61 of the folding roller 57(*a*) rotates the cam drive shaft 111 in a constant, intermittent manner because of the Geneva mechanism, not shown in FIG. 7(*a*) and FIG. 7(*b*).

A cam plate 114 is fastened to the cam drive shaft 111. The shaft 111 rotates to driven the cam plate 114. A timing of the cam plate 114 (intermittent movement) is set so that the pushing plate moves at a speed approximately 2.2 times faster than the transport speed of the folding rollers (57*a* and 57*b*) The cam plate 114 has a cam groove 114*b*. A cam follower 116 projecting substantially from a center of the actuator arm 115 rotatable around the shaft 113 is inserted in the cam groove 114*b*. To the leading edge of the actuator arm 115 is mounted the pushing plate 55 via the support holder 110.

Therefore, when the cam plate 114 rotates, the actuator arm 115 also rises and lowers, and the pushing plate 55 mounted to the actuator arm 115 also rises and lowers. The pushing plate 55 pushing the sheet stack is formed of a stainless steel plate with a thickness of an approximately 0.25 mm. Next, the support holder 110 that supports the pushing plate 55 is interconnected to the backup guides (59*a* and 59*b*) that guide the circumference of the folding rollers (57*a* and 57*b*).

The backup guides (59*a* and 59*b*) are arranged to cover the outer circumference surface of the cylindrical folding rollers (57*a* and 57*b*), extending in a direction perpendicular to the sheet transport direction, and are rotatable relative to the outer circumference surface of the folding rollers (57*a* and 57*b*) around shafts (61 and 62) of the folding rollers (57*a* and 57*b*).

To the outer circumference sides of the backup guides (59*a* and 59*b*) are disposed levers (119 and 120), respectively. The backup guides (59*a* and 59*b*) both are pulled by the spring 121. The levers (119 and 120) are supported by the actuators (117 and 118) branched from the support holder 110 into two parts. Therefore, the backup guides (59*a* and 59*b*) are positioned to cover the outer circumference of the transport path of the folding rollers (57*a* and 57*b*) in the state shown in FIG. 7(*a*), and to function as guides that backup (or support) the sheet stack for guiding the sheet stack in a state of fully contacting the rubber surface of the folding rollers (57*a* and 57*b*). Note that the backup guides (59*a* and 59*b*) normally function as a sheet transport guide and sheet stack bottom side transport guide.

When the sheet stack is folded, the levers (119 and 120) are pushed upward by the downward action of the actuators (117 and 118) on the support holder, as can be seen in FIG. 7(*b*). As a result, the backup guides (59*a* and 59*b*) rotate around the shafts (61 and 62) against the spring 121 to securely contact the outer circumference of the folding rollers (57*a* and 57*b*) to the sheet stack.

The following will describe a drive transmission system of the folding unit 50. The drive transmission system is separated into a rotating and separating system of the stack transport upper roller 51 and the stack transport lower roller 52 shown in FIG. 8 and FIG. 9, and a drive transmission system of the folding rollers (57*a* and 57*b*) and pushing plate shown in FIG. 11(*a*) and FIG. 11(*b*). The transmission systems are disposed at the backside frame of the folding unit frame 49 shown in FIG. 6.

Figure 8:
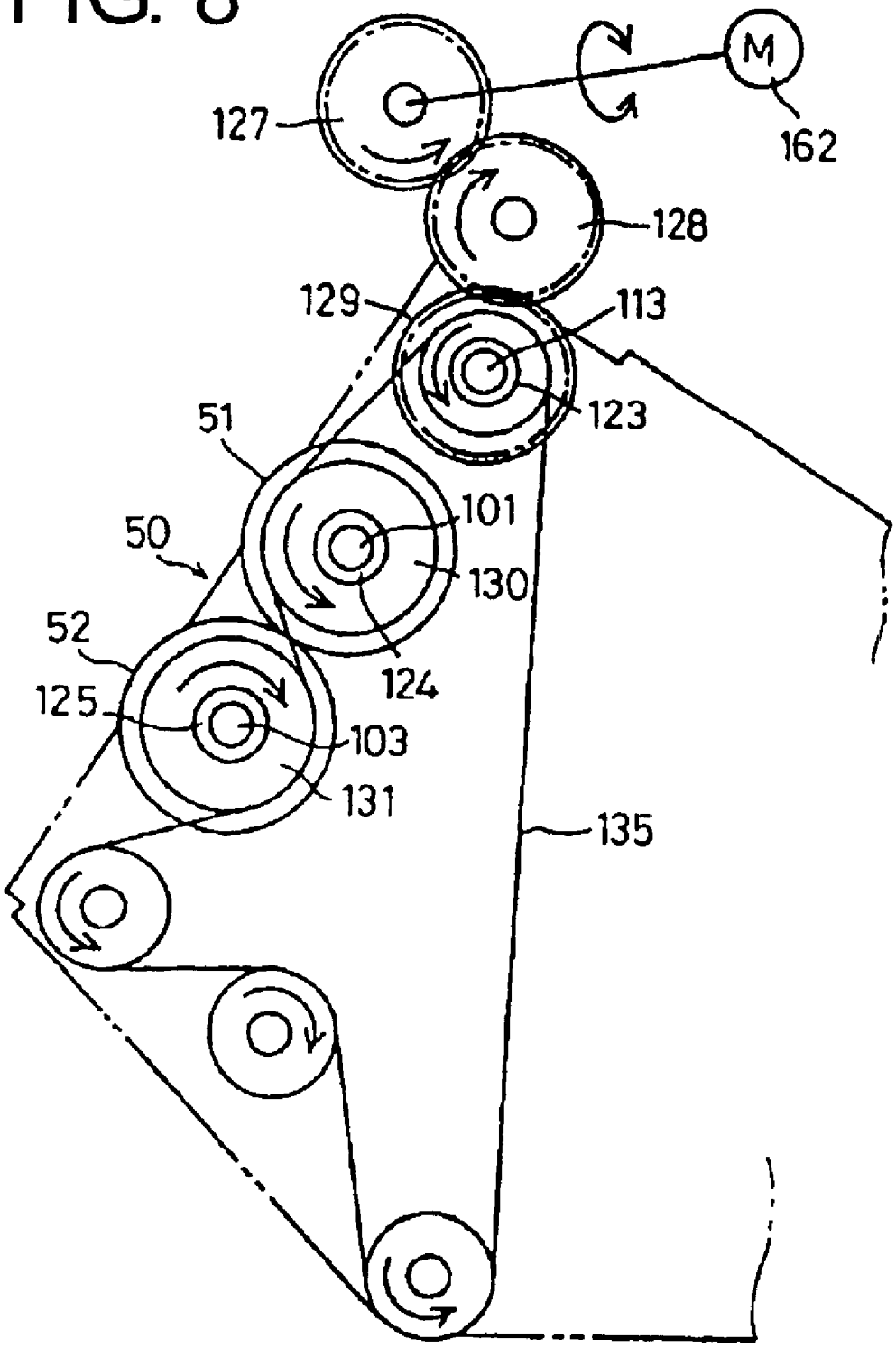
FIG. 8 is a view of a drive mechanism of the folding unit in the sheet post-processing apparatus.
Figure 9:
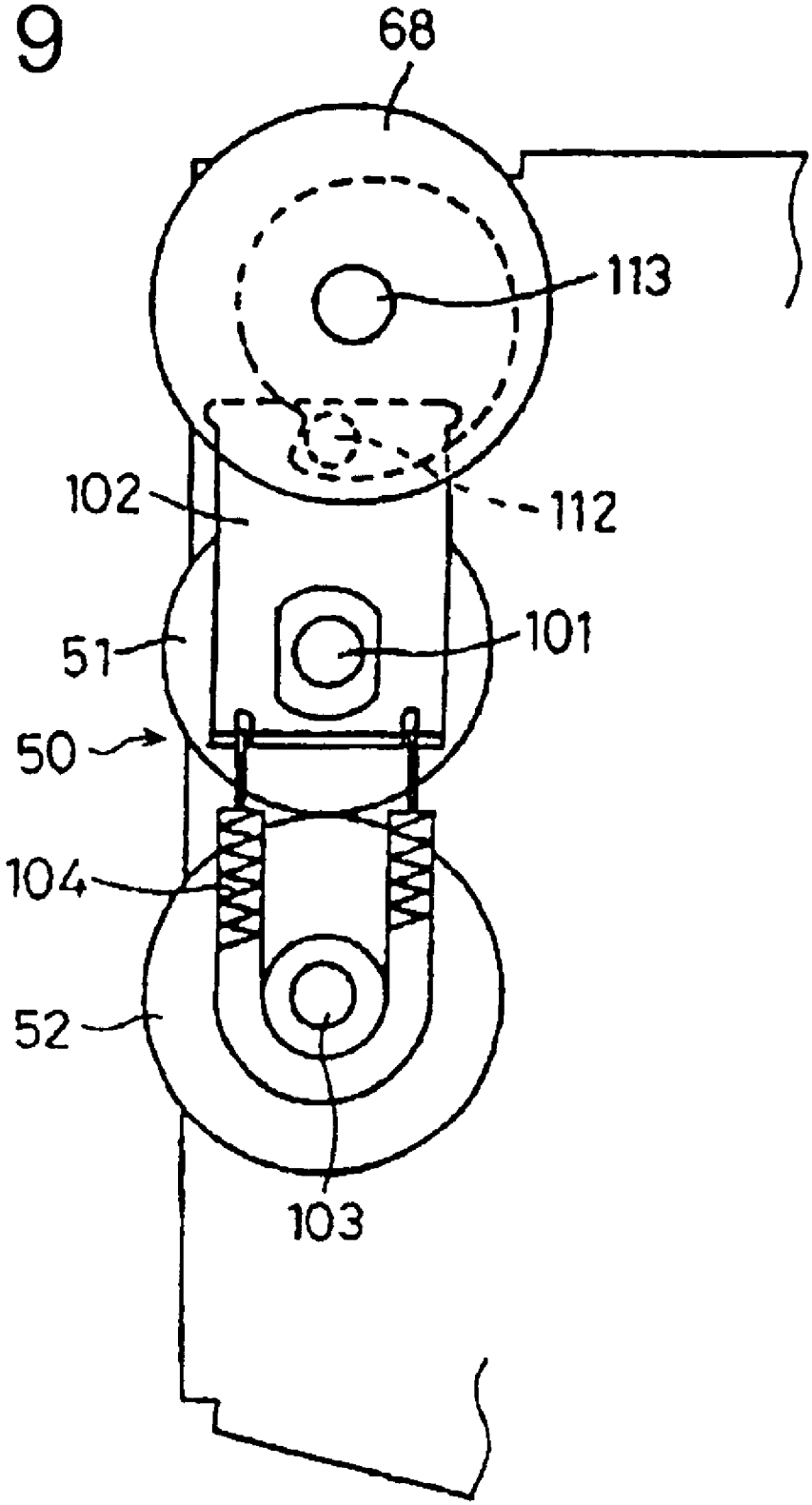
FIG. 9 is a view of the drive mechanism of the folding unit in the sheet post-processing apparatus.

The drive system for the stack transport upper roller 51 and stack transport lower roller 52 shown in FIG. 8 and FIG. 9 is input to the gear pulley 29 on the folding unit 50 side via gears (127 and 128) from the transport motor 162 capable of rotating in both directions and disposed on the sheet post-processing apparatus 2. A one-way clutch 123 is interposed between the gear pulley 129 and the shaft 113 that drives the upper roller movement cam 68. Due to the one-way clutch 123, the upper roller movement cam 68 rotates to move the stack transport upper roller 51 vertically only when the gear pulley 129 rotates in one direction (rotation in the direction opposite to the arrow directions in FIG. 8). The drive from the gear pulley 129 is transmitted to the stack transport upper roller shaft 101 and lower roller shaft 103 via the timing belt 135 by the pulleys (130 and 131). Note that one-way clutches (124 and 125) are interposed between the pulleys (130 and 131) and shafts (101 and 103), and the shafts (101 and 103) are driven by the drive from the pulleys 130 and 131 (the direction of the arrows in FIG. 8).

By rotating the gear pulley 129 of FIG. 8 in the direction of the arrow, the stack transport upper roller 51 and the stack transport lower roller 52 rotate in a direction to transport the sheet stack into the folding unit 50. When the gear pulley 129 rotates in the direction opposite to the arrow shown in the drawing, the upper roller movement cam 68 rotates as just described, and the stack transport upper roller 51 is pressed thereto or separated from the stack transport lower roller 52. This action is controlled through a sensor detection of a flag protrusion disposed on the shaft 113, not shown in the drawings.

Figure 10:
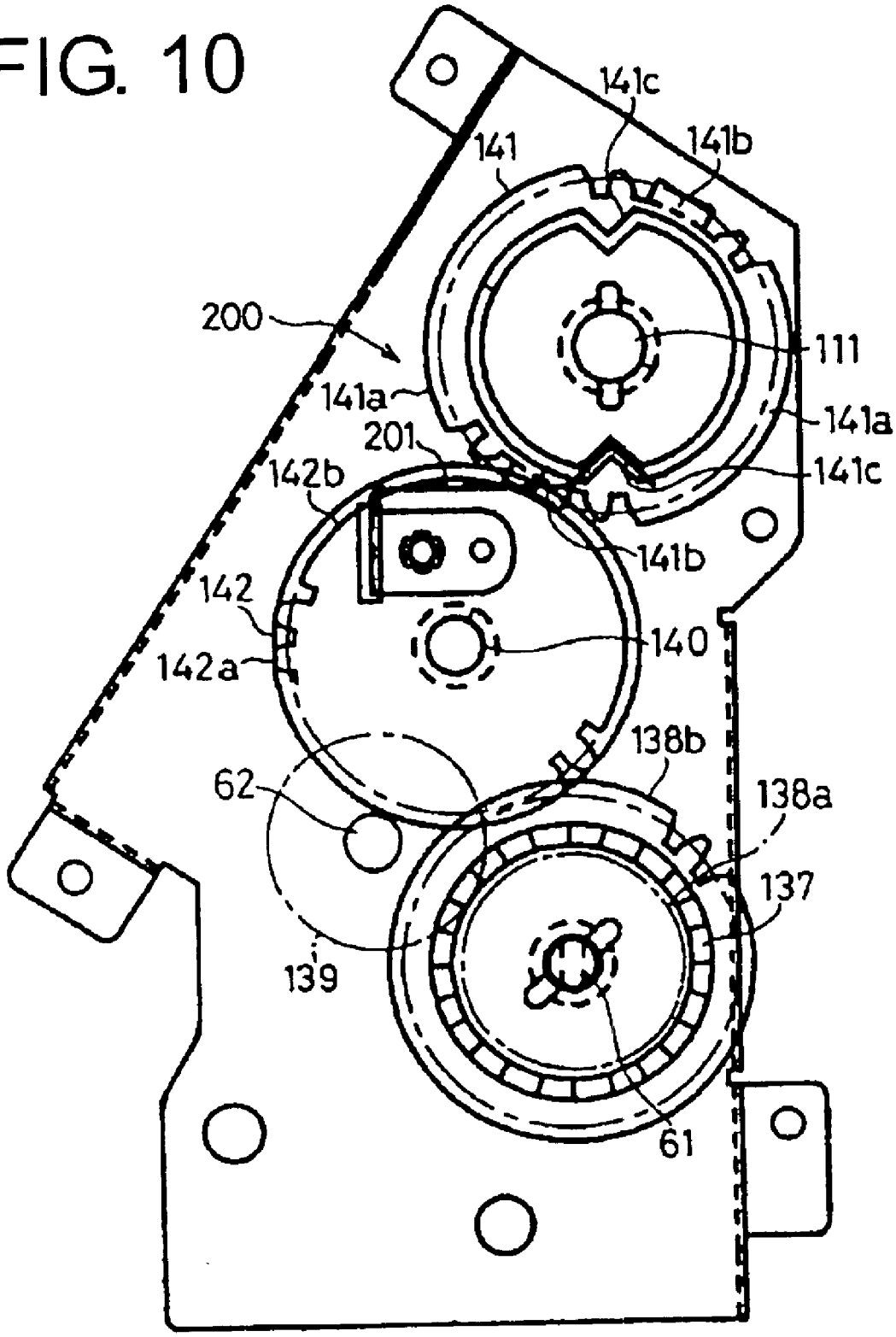
FIG. 10 is a view of a Geneva mechanism of the folding unit in the sheet post-processing apparatus.

FIG. 10 shows the drive transmission system of the folding rollers (57*a* and 57*b*) and the intermittent drive transmission system of the pushing plate 55. They are mounted to the frame on the back side of the drive system shown in FIG. 8 and FIG. 9.

The drive of the staple/folding motor (rotation drive means) 170 (see FIG. 16) from the sheet post-processing apparatus 2 side is received by the coupling device 137. Note that although not shown in the drawings, the staple/folding motor 170 drives the coupling device 44 of the stapling unit shown in FIG. 4 with a forward rotation, and rotates the aforementioned coupling device 137 with a reverse rotation.

The drive from the coupling device 137 is transmitted to the 139 disposed on the shaft 62 that rotates the folding rollers 57*a* using the gear 138*a*, and to the gear 142 by the gear 138*b*. A Geneva mechanism is incorporated on the side surface of the gear 142 and the side surface of the gear 141. The rotation of the gear 142 is transmitted as an intermittent rotating action to the shaft 111 by the gear 141. FIG. 10 shows the configuration in one rotation of the drive shaft 111 of the pushing plate 55 when the folding rollers (57*a* and 57*b*) rotate twice. Note that, although not shown in the drawings, the sensor detects the flag protrusion fastened to the shaft 111 to determine the position of the cam plate 144.

The Geneva mechanism 200 is provided with gear 142 and gear 141 having the same pitch arc. The gear 142 has teeth 142*a* formed on one half of the circumference and an arc portion 142*b* on the other half of the circumference. The gear 141 has teeth 141*a* mating with the teeth 142*a* on the gear 142, stopper portions 141*b* positioned in the array of the teeth 141*a* with an approximately 180 degree interval, and notches 141*c* positioned in the array of the teeth 141*a* with an approximately 180 degree interval.

When the gear 142 rotates, the gear 141 rotates through the teeth 142*a* and teeth 141*a* mating each other. When the gear 142 rotates in a half rotation, the arc portion 142*b* faces the stopper portion 141*b*, so the rotation of the gear 142 is not transmitted to the gear 141. As a result, the gear 142 continues to rotate, and the gear 141 stops rotating. When the gear 142 rotates further in a half rotation, the gear 142*a* mates again with the teeth 141*a* and the gear 141 rotates again. In this manner, when the gear 142 rotates in a full rotation, the gear 141 intermittently rotates in a half rotation. The gear 141 is positioned for each of the half rotation when the elastic stopper 201 disposed on the fastening member engages the notch 141*c*, and the arc portion 142*b* is held to face the stopper portion 141*b*.

The gear 141 is disposed on the cam drive shaft 111, and the cam plate 114 is disposed on the cam drive shaft, as shown in FIG. 7(*a*). Thus, as described above, when the folding rollers (57*a* and 57*b*) rotate twice, the cam plate 114 rotates one time. At the same time, when the folding rollers (57*a* and 57*b*) rotate twice, the pushing plate 55 that interlocks the cam plate 114 reciprocates one time. Moreover, the gear 141 rotates intermittently, so the cam plate 114 also rotates intermittently. While the cam plate 114 is stopped, due to the shape of the cam 114, the pushing plate 55 is held at an idling position away from the folding rollers (57*a* and 57*b*) as can be seen in FIG. 7(*a*) and FIG. 7(*b*). Through this configuration, the pushing plate 55 does not contact the trailing edge of the sheets to damage the sheets during the folding process of the folding rollers (57*a* and 57*b*).

Note that the gear 138*a* (see FIG. 10), the Geneva mechanism 200, the cam plate 114 (see FIG. 7(*a*) and FIG. 7(*b*), the cam 114*a*, the cam follower 116, the shaft 113, and the actuator arm 115 compose the motion converting mechanism 202 that reciprocally moves the pushing plate 55 once per one sheet folding transport action of the folding rollers (57*a* and 57*b*). Also, the pushing plate holder 110, the pushing plate frame guide 65, the movement roller 66 and the pushing plate 55 compose the sheet pushing means.

Figure 11A:
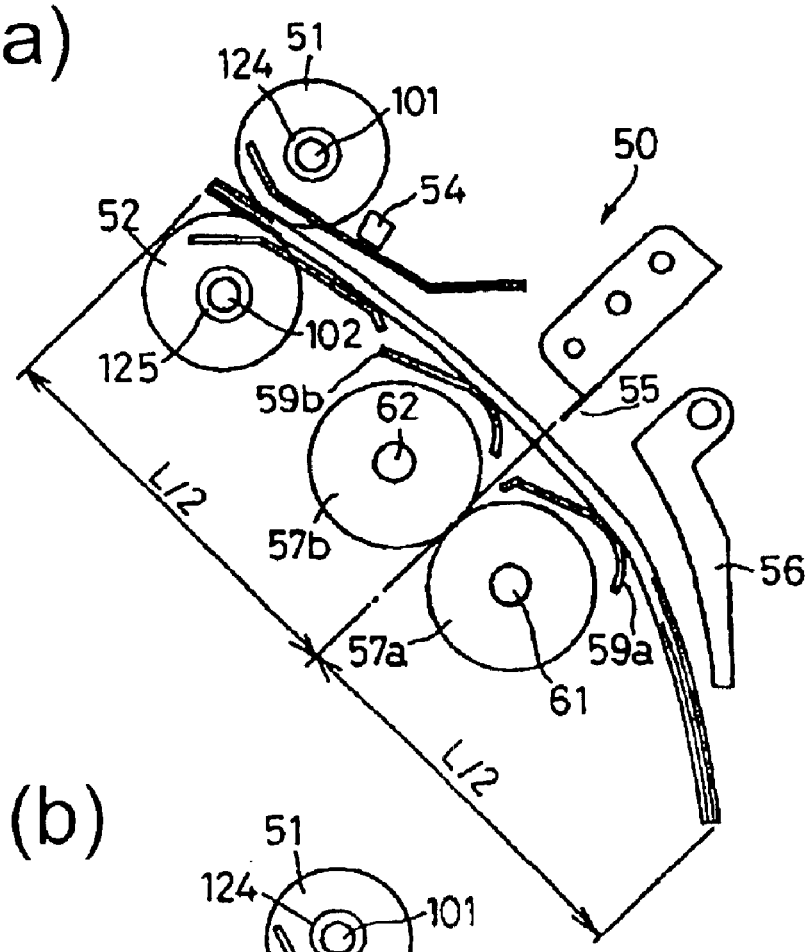
FIGS. 11(*a*) and 11(*b*) are explanatory views showing an operation of folding a sheet stack using a pushing plate of the folding unit in the sheet post-processing apparatus, wherein FIG. 11(*a*) shows a state before the folding unit folds the sheet stack and FIG. 11(*b*) shows a state that the folding unit folds the sheet stack.
Figure 11B:
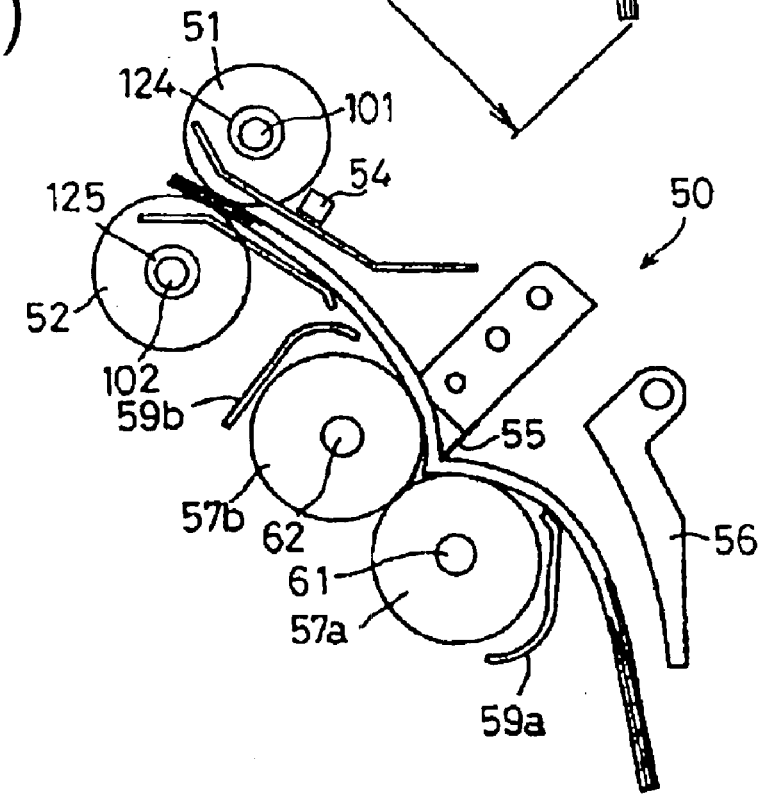

The following will describe the sheet folding action in the folding unit 50 with reference to FIG. 11(*a*) and FIG. 11(*b*). To staple (saddle-stitch) the sheets substantially at the center thereof in the transport direction in the process tray 8, the sheet stack is transported into the folding unit 50 with the stack transport upper roller 51 and the stack transport lower roller 52 in the separated state. Then, when the leading edge of the sheet stack is detected, the stapling is performed at a position that is calculated to be the center in the sheet stack transport direction. Then, the upper roller movement cam 68 (see FIG. 6) is rotated to press the stack transport upper roller 51 against the stack transport lower roller 52. The stack transport upper roller 51 and the stack transport lower roller 52 are driven to transport the sheet stack until the center in the sheet transport direction is positioned directly below the pushing plate 55. At this point, the guide members (backup guides 59*a* and 59*b*) are positioned to cover the circumference of the folding rollers (57*a* and 57*b*). Also, because the guide members support the bottom surface of the sheet stack, the sheet stack is smoothly transported. When the substantial center in the sheet stack transport direction is positioned directly below the pushing plate 55, the stack sensor 54 detects that state. The stack transport upper roller 51 and the stack transport lower roller 52 stop driving temporarily.

When the sheet stack reaches the state shown in FIG. 11(*a*), the folding rollers drive shaft 61 is driven to rotate. When the folding rollers drive shaft 61 rotates, the folding rollers (57*a* and 57*b*) also rotate, and the cam plate 114 (see FIG. 7(*a*) and FIG. 7(*b*)), with the Geneva mechanism, intermittently rotates to reciprocally move the pushing plate 55 up to the nip of the folding rollers (57*a* and 57*b*). The rollers 57*a* and 57*b* rotate while folding the sheet stack. The folded sheet stack is then discharged to the discharge stacker 80.

Note that when the pushing plate 55 is pushing the sheet stack at the middle of the length (L) (the half-way point, L/2) toward the folding rollers (57*a* and 57*b*), the upper roller shaft 101 for the stack transport upper roller 51 and the lower roller shaft 103 for the stack transport lower roller 52 are stopped. Since the one-way clutches 124 and 125 (see FIG. 8) are interposed between the stack transport upper roller 51 and the stack transport lower roller 52 and shafts (101 and 103), while the sheet stack is being folded by the pushing plate 55, the stack transport upper roller 51 and the stack transport lower roller 52 rotate as pulled by the sheet stack, so that there is no hindrance against the folding of the sheet stack. Therefore, the sheet stack is smoothly folded by the folding rollers (57*a* and 57*b*). Then, the sheet stack is discharged to the sheet stack discharge stacker 80 from the folding unit 50 by the folding rollers (57*a* and 57*b*).

Figure 12:
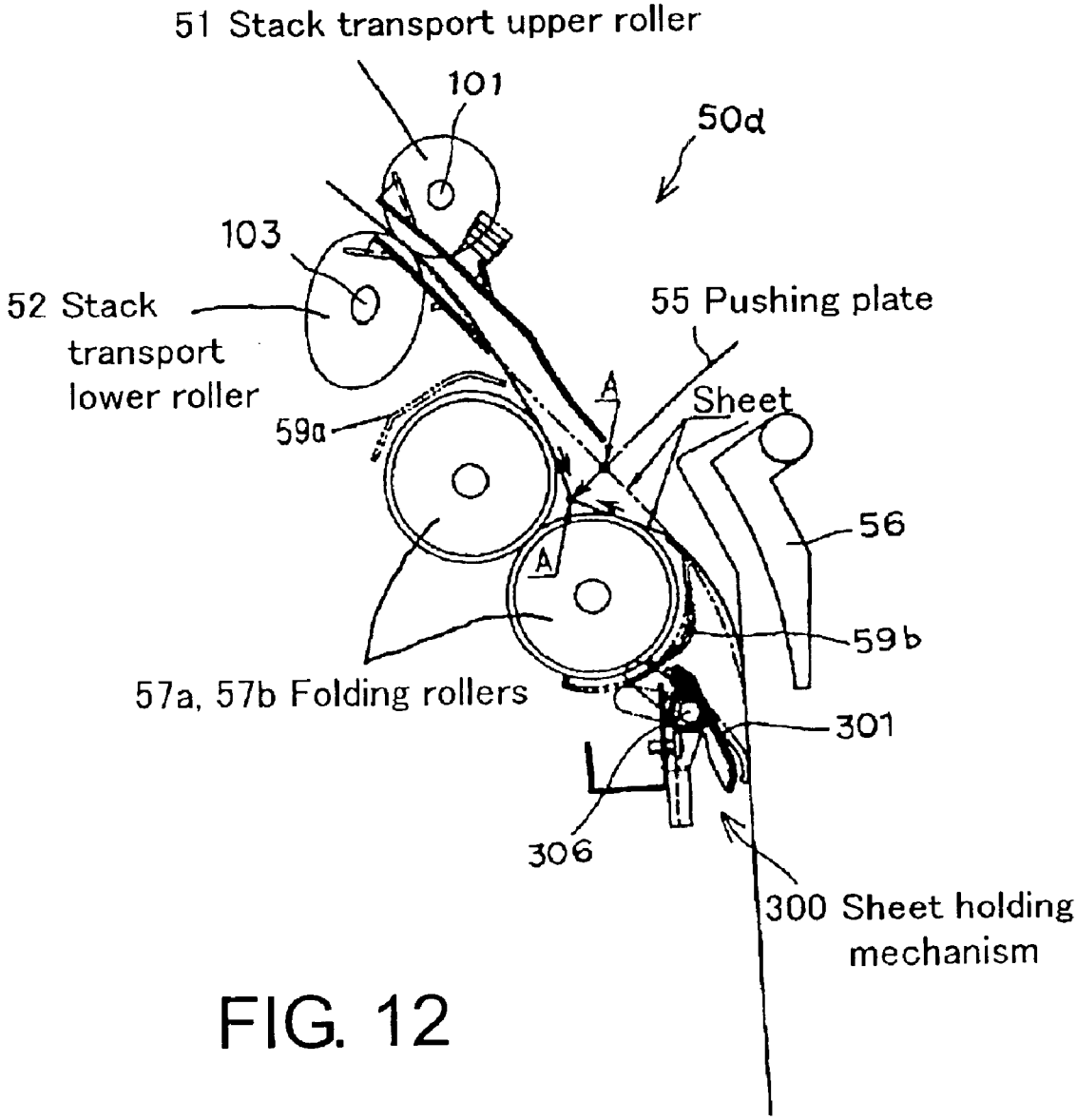
FIG. 12 is a view of a sheet holding mechanism of a folding unit in a sheet post-processing apparatus according to the first embodiment.
Figure 14A:
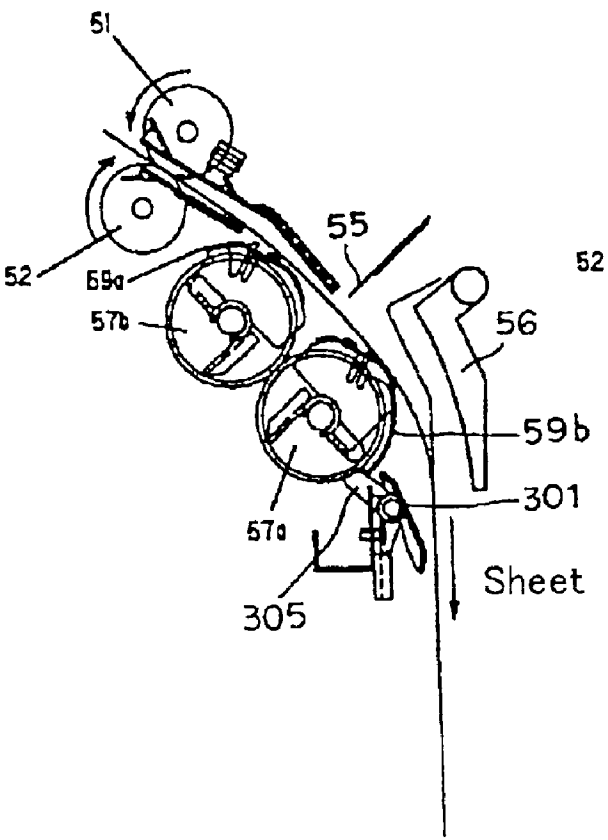
FIGS. 14(*a*) and 14(*c*) are explanatory views showing an operation of a sheet holding mechanism of the folding unit in the sheet post-processing apparatus, wherein FIG. 14(*a*) shows an operation of transporting the sheet, FIG. 14(*b*) shows an operation of starting the sheet folding operation, and FIG. 14(*c*) shows an operation when the sheet folding operation is completed.
Figure 14B:
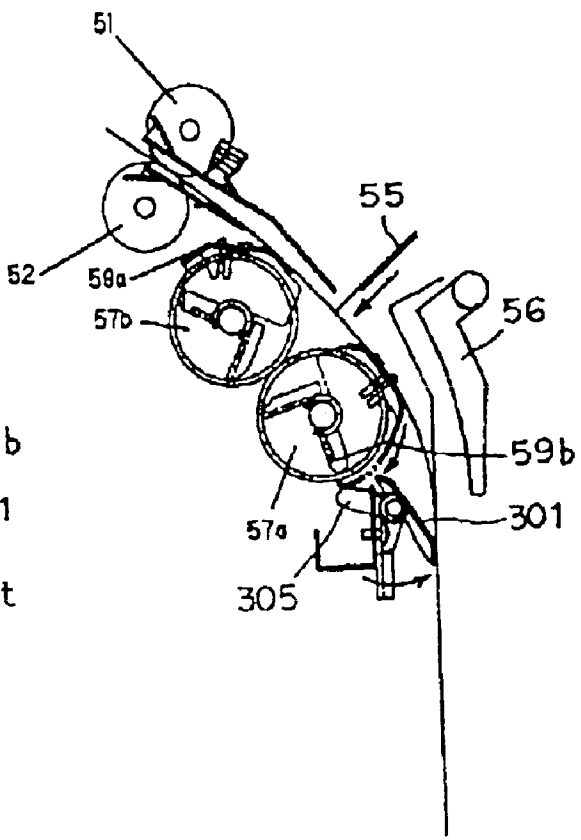
Figure 14C:
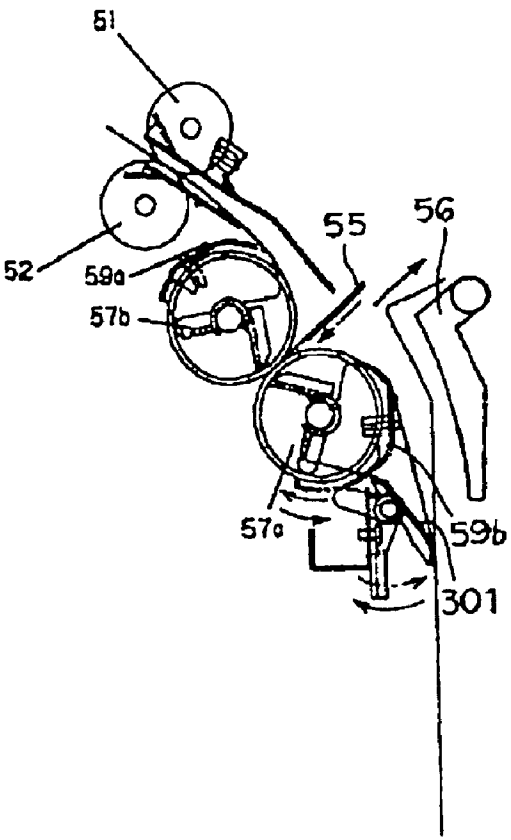

In addition to the mechanism described above, this invention also has a feature in which the second load means is provided for nipping the downstream side of the supplied sheet stacks. FIG. 12 to FIGS. 14(*a*) and 14(*b*) show the first embodiment of a folding unit 50*a* that is equipped with the second load means. As can be seen in FIG. 13(*a*), the sheet holding mechanism 300 is equipped with a lever 301 for pushing the sheet stack along the backup guide 59*b*. As can be seen in FIG. 13(*b*), this lever 301 is rotatably arranged to a support means 302 mounted to the frame 310 on the main unit (not shown) via a rotating shaft 306. Also, by mounting a return spring 303 and holding member 304 to a link lever 305 on the rotating shaft 306, the lever 301 can press with a constant force. The link lever 305 is incorporated into the end of the backup guide 59*b*, as can be seen in FIG. 13(*a*). The lever is rotatably interconnected to the action of the pushing plate 55 shown in FIG. 12, and is lowered by the backup guide 59*b*. With this pushing downward action, the link lever 305 rotates counterclockwise around the rotating shaft 306 for applying torsion to the return spring 303. Since the torsion force is transmitted to the lever 301 via the holding member 304, the lever 301 maintains the constant force and lifts upward to push the leading edge of the sheet stack supported thereupon into the guide 56. At this point, the pushing plate 55 is not in contact with the sheet stack, so both edges of the sheet stack are firmly held until just prior to the folding action of the sheet stack. Also, while the pushing plate 55 pushes the sheet stack, the lever 301 applies a constant pressure to securely press the sheet stack. When the pushing action is completed, the backup guide 59*b* is interconnected to the action to return the pushing plate 55 to an original position, and rotates in the reverse direction to release the pushing downward of the link lever 305. Accordingly, the pressure applied to the lever 301 is eliminated, and the lever 301 returns to an initial position by the repulsion of the return spring 303 and its own weight.

As shown in FIG. 6, the first load means (stack transport upper roller 51 and stack transport lower roller 52) are rotatably supported between a sheet contact position and a retracted position by the first support means (upper roller shaft 101 and lower roller shaft 103). Also, the second load means (lever 301) are rotatably supported between a sheet (downstream side) contact position and a retracted position by a second support means (rotating shaft 306).

The following will describe the folding operation of the folding unit 50 in the first embodiment of the sheet holding mechanism 300 with reference to FIG. 14(*a*) to FIG. 14(*c*). As can be seen in FIG. 14(*a*), the sheet stack is transported to the folding rotating bodies (folding rollers (57*a* and 57*b*)) by the stack transport upper roller 51 and the stack transport lower roller 52. In this state, the folding rollers (57*a* and 57*b*) are not rotating, so the lever 301 equipped on the sheet holder mechanism 300 is positioned at a retracted position where it does not contact the sheet stack. The leading edge of the transported sheet stack hangs downward under its own weight. Next, as shown in FIG. 14(*b*), the sheet pushing member (pushing plate 55) lowers toward the folding position (A) of the sheet stack. The folding rollers (57*a* and 57*b*) are interconnected with the lowering action of the pushing plate 55, and start rotating inwardly together. Accordingly, an interlock means (backup guides 59*b*) disposed on the folding rollers (57*a* and 57*b*) operates the link lever 305 on the sheet holding mechanism 300 to push the lever 301 upward, thereby holding the sheet stack. At this time, the stack transport upper roller 51 and stack transport lower roller 52, i.e. the first load means, apply a load on the upstream side of the sheet stack substantially equal to a load that the lever 301, i.e. the second load means, applies on the downstream side the sheet stack. Therefore, when the pushing plate 55 pushes the sheet stack, an amount of the sheet stack pulled from the upstream side is about equal to that pulled from the downstream side. Thus, there is no shift between the position on the sheet stack where the pushing plate 55 contacts and the actual folding position. FIG. 14(*c*) shows a state that the folding action is completed. When the pushing plate 55 is retracted, the folding rollers (57*a* and 57*b*) also rotate in the direction shown in FIG. 14(*b*) to return to the state shown in FIG. 14(*a*). Accompanied with this movement, the pressure of the lever 301 is released when the link lever 305 returns to the original position. Then, the sheet stack is discharged from the folding unit 50 by rotating the pair of stack transport rollers (51 and 52). Note that the transport motor 162 that drives the stack transport upper roller 51 and stack transport lower roller 52 and the folding motor 170 that drives the folding rollers (57*a* and 57*b*) are controlled in the control means (control block 149), which are described below.

FIG. 15 shows the configuration of the folding unit 50*b* according to the second embodiment. The second load means (sheet holding means 400) according to this embodiment is composed of a pair of holding rollers (401 and 402). These holding rollers (401 and 402) are formed of the same shape and size as the stack transport upper roller 51 and stack transport lower roller 52 in the first load means, and can be set to apply an equivalent pressure to nip the sheet stack by sharing the drive means (transport motor 162). Also, in the folding unit 50 according to the first embodiment, the sheet holding mechanism 300 is mechanically interconnected with the folding rollers 57*b*. In the second embodiment of the present invention, because of an independent structure, it is easy to control the nip pressure of the stack transport upper roller 51 and stack transport lower roller 52. Also, after the sheet stacks are folded, the sheet stacks can be transported or discharged only with the holding rollers (401 and 402).

Figure 16:
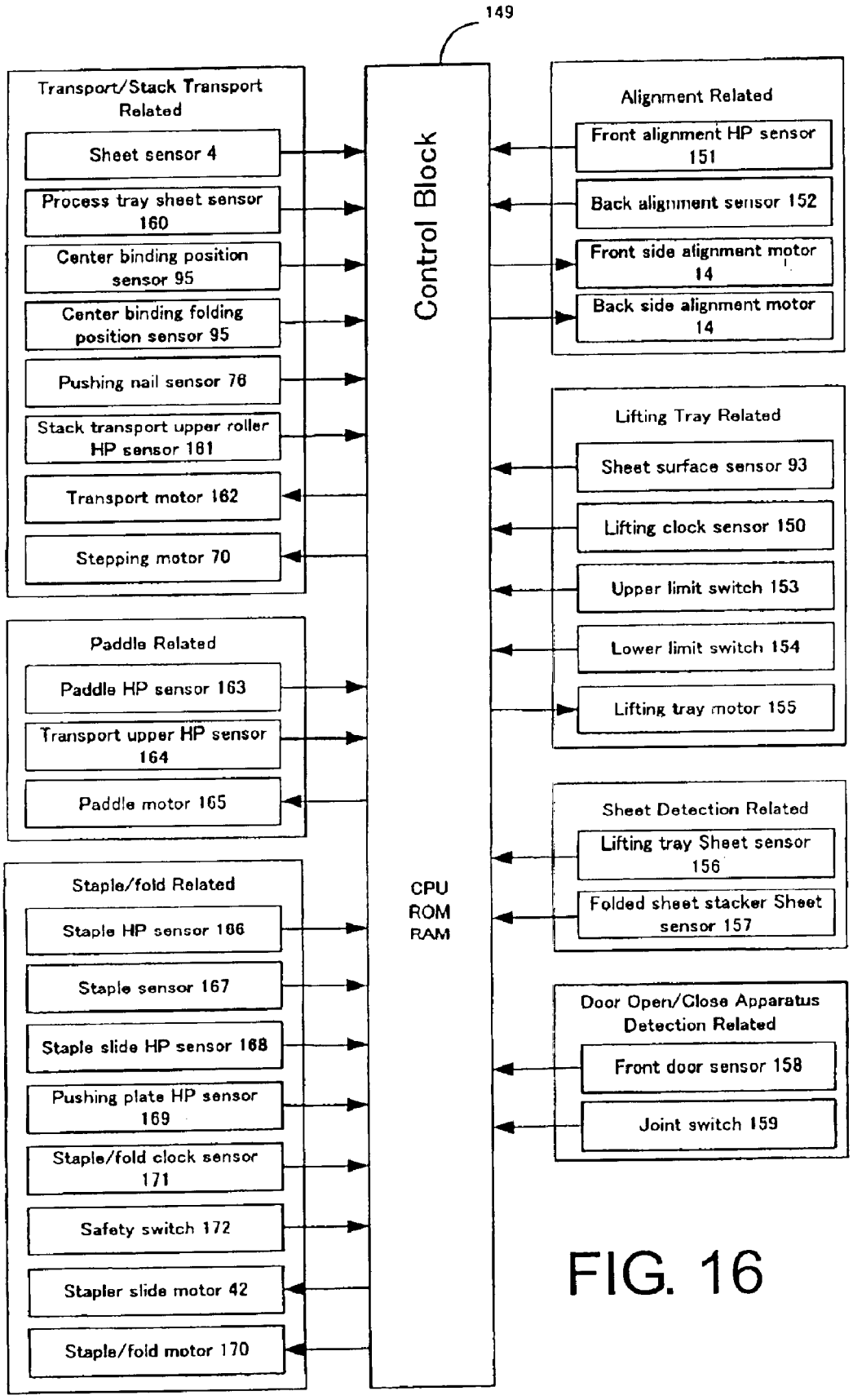
FIG. 16 is a block diagram showing a control of the sheet post-processing apparatus.

FIG. 16 shows a schematic block diagram relating to the control of the sheet post-processing apparatus 2. The control block 149 comprises the central processing unit (or CPU), the ROM prerecorded with control means for execution by the CPU, and the RAM for storing the CPU calculation data and the control data received from the main unit 1 of the copier 20.

To the control block 149 are disposed a plurality of I/O functions. The arrows pointing toward the control block 149 represent the input side; the arrows pointing away from the control block 149 represent the output side.

The circuits related to sheet alignment are equipped with the front side alignment HP sensor 151 and backside alignment HP sensor 152 for setting the home position (HP) of the alignment plate 9 to align both edges of the sheet stack on the process tray 8. The alignment plate 9 (see FIG. 2) idles at positions of the front side alignment HP sensor 151 and backside alignment HP sensor 152 until the first sheet is transported into the process tray 8. The front side alignment motor 14 is a pulse motor that moves the front side alignment plate 9. The backside alignment motor 14 is a pulse motor that moves the backside alignment plate 9. The alignment plates 9 are moved to align the width according to the width of the sheet stack by each of the alignment motors 14. The alignment plates 9 can be set freely to shift in a direction perpendicular to the sheet in the sheet stack transport direction.

The circuits relating to the lifting tray 90 include, the paper surface sensor 93 that detects the uppermost surface of a sheet on the lifting tray 90, the lift clock sensor 150 that detects an amount of rotation of the lifting tray motor 155 using an encoder, and an upper limit switch 153 and a lower limit switch 154 for regulating a vertical movement range of the lifting tray 90. These circuits control the lifting tray motor 155 and drive the lifting tray 90 by the input signals of the sensors (93 and 150) and switches (153 and 154).

The circuits that relate to detecting whether a sheet or a sheet stack is stacked on the lifting tray 90 and the folded sheet discharge stacker 80 are equipped with a lifting tray sheet sensor 156 for detecting the presence of a sheet stack on the lifting tray 90 and a folded sheet stack sensor 157 in the folded sheet stack discharge stacker 80. These sensors (156 and 157) are used to notify an operator when there is a sheet remaining before starting the sheet post-processing apparatus, or when the sheet stack is not removed after the passage of a predetermined amount of time.

The circuits relating to the door open/close device sensors that detect whether a door is open on the sheet post-processing apparatus 2, or whether the sheet post-processing apparatus main unit 2 is properly mounted to the main unit 1 of the image forming apparatus 20 are equipped with the front door sensor 158 and the joint switch 159 that detects whether the sheet post-processing apparatus 2 is properly mounted to the copier main unit 1.

The circuits relating to the sheet stack transport operations when transporting or stacking the sheet stacks are equipped with the sheet sensor 4 that detects that a sheet has been transferred into the sheet post-processing apparatus 1 from the main unit 1 of the copier 20 by the transfer guide 3, the process tray sheet sensor 160 that detects the presence of sheets on the process tray 8, saddle-stitch folding position and saddle-stitch folding position sensors (95 and 95) that detect the leading edge of a sheet stack in the sheet transport direction to calculate the position to drive the staples into the center position of a sheet stack in the sheet transport direction supplied from the process tray and the position to fold the sheet stack in the same position as that where the staples are driven, pushing nail sensor 76 that detects the home position of the pushing nail 13 disposed on the transport belt 12 that transports the sheet stack on the process tray 8 to the lifting tray 90, and the stack transport upper roller sensor 161 that detects the home position of a position separated from the stack transport lower roller 52 by the stack transport upper roller 51 at the inlet of the folding unit 50. The transport motor 162 and stepping motor 70 are controlled according to the signals from these sensors. The rotational force is transmitted from the transport motor 162 to the pair of transport rollers 5, the pair of discharge rollers 6, the stack transport upper roller 51 and the stack transport lower roller 52. The reverse rotation of the transport motor 162 rotates the upper roller transport cam 68 that moves the stack transport upper roller 51. The rotational force of the stepping motor 70 is transmitted to the transport lower roller 18 arranged on the process tray 8, the transport upper roller, and the first pulley 10 that circulates the transport belt 12.

The circuits relating to the control of the paddle 17 are equipped with a paddle HP sensor 163 for detecting a position of rotation of the paddle 17, and a transport HP sensor 164 for detecting a position where the transport upper roller 19 is disengaged from the transport lower roller 18. The paddle motor 164 is controlled according to the signals output from each of the sensors (163 and 164).

The circuits relating to the control of the staple/fold operations include the staple HP sensor 166 that detects that the drive head unit 31 and the anvil unit 32 in the stapler unit 30 are both ready to staple, the staple sensor 167 that detects whether the staples are set in the drive head unit 31, the staple slide HP sensor 168 that detects whether the drive head unit 31 and anvil unit 32 are at their initial positions (the positions shown in FIG. 4) when shifted in the sheet transport direction, the staple/fold clock sensor 171 that detects the rotational direction of the staple/fold motor 170 that switches the drive of the staple unit 30 and the folding unit 50 with forward or reverse rotation, and the safety switch 172 that detects that the staple unit 30 and the folding unit 50 are in an operable state. The staple slide motor 42 and staple/fold motor 170 are controlled according to these sensors and switch.

The staple slide motor 42 transmits the rotational force to the guide screw shaft 36 that moves the drive head unit 31 and anvil unit 32 in a direction traversing the sheet transport direction. The staple/fold motor 170 drives the coupling device 44 of the stapler unit 30 (see FIG. 4) with one rotation in one of the forward and reverse directions, and the coupling device 137 of the folding unit 50 (see FIG. 10) with rotation in the other of the directions.

Next, an operation of the sheet post-processing apparatus 2 in processing mode will be explained below. There are three basic processing modes, describe below.

Non-staple mode: A mode in which the sheets are stacked on the lifting tray without stapling.

Side staple mode: A mode in which one lcoation or a plurality of locations on the edge (side) of the sheets in the transport direction is stapled.

Saddle-stitch mode: A mode in which the sheets are stapled at a plurality of positons at the middle of the sheet length in the sheet transport direction, are folded at the stitched position to form a booklet, and are stacked the sheet stacks on the stack discharge stacker 80.

When the non-stapling mode is selected, the control block 149 activates the stepping motor 70 to rotate the transport belt. The pushing nail 3 moves from the home position (see the HP in FIG. 3) to the pre-home position (see the Pre-HP position in FIG. 3), i.e. the sheet stacking reference position on the process tray 8. Simultaneously, the control unit 149 activates the transport motor 162 to rotate the transport roller pair 5 and discharge roller pair 6, and waits to discharge the sheet from the discharge rollers (1*a* and 1*b*) in the main unit 1 of the copier 20. The transport roller pair 5 and discharge roller pair 6 transport the discharged sheet to the process tray 8. When the sheet sensor 4 detects the sheet, the control unit 9 measures a start timing of the alignment motor 14 to move the alignment plate 9 and paddle motor 165 to rotate the paddle 17.

When the sheet is discharged into the process tray 8, the control block 149 drives the alignment motor 14 and paddle motor 165. This drive moves the alignment plate 9 in the width direction perpendicular to the sheet transport direction to align both edges of the sheet. The paddle 17 rotates so that the edge of the sheet is aligned along the end of the pushing nail 13 situated at the pre-HP position. These steps of the operation are repeated every time when the sheet is discharged into the process tray 8. When a predetermined number of sheets are aligned on the pushing nail 13, the control block 149 stops the transport motor 162 and paddle motor 165, and restarts the stepping motor 70 to drive the transport belt 12. This moves the sheet stack to the lifting tray (the direction of arrow A in FIG. 1). Accordingly, the sheet stack is moved to be stacked in the lifting tray 90. Along with the discharging of the sheet stack, the control block 149 lowers the lifting tray motor 155 for a fixed amount in the direction of lowering the lifting tray 90. Then, it drives and stops in the rising direction until the sheet surface sensor 93 detects the uppermost sheet. It idles until the next sheet stack is stacked.

When the side-staple mode is selected, the control unit 149 activates the transport motor 162 to rotate the transport roller pair 5 and discharge roller pair 6 to discharge and stack the sheet from the main unit 1 of the copier 20 to the process tray 8. When the sheet is discharged and stacked, the control block 149 drives the alignment motor 14 and paddle motor 165. Through this, both sides of the sheet in the width direction are aligned along the alignment plate 9, and the sheet is transported and stopped at the stopper 21. This is repeated a specified number of times.

In a state that the sheet stack is regulated by the stopper 21, the transport upper roller 19 is moved to the transport lower roller 18 side to nip the sheet stack between the transport upper roller 19 and the transport lower roller 18. Then, the control block 149 drives the staple/fold motor 170 to rotate in the staple operating direction to stitch the sheet stack, and staples the sheet stack using the drive head unit 31 and anvil unit 32. Note that when the stitching operation is performed at several positions on the sheet edges, the control unit 149 activates the stapler slide motor 42 to move before the stitching operation.

When the stitching operation is completed, the stitched sheet stack is moved to the lifting tray 90 (in the direction of arrow A in FIG. 1) by driving the stepping motor that drives the transport lower roller 18, the transport upper roller 19 and the transport belt 12. Through this action, the sheet stack is handed over from the transport lower roller 18 to the transport upper roller 19 to the pushing nail 13, and is stacked in the lifting tray 90. The remaining operation of the lifting tray 90 is the same as that of the non-stapling mode, thus the explanation thereof is omitted.

The saddle-stitching mode stitches the sheet stack at the substantial center position in the sheet length in the sheet transport direction and folds the stapled sheet stack. The operation to the stack sheets discharged to the process tray 8 from the image forming apparatus 1 is the same as the side-stitching mode, and thus an explanation thereof is omitted.

After aligning and stacking the sheets on the process tray 8, the transport upper roller 19 is moved to the transport lower roller 18 side to nip the sheet stack between the transport upper roller 19 and the transport lower roller 18. Next, the stopper 21 is retracted from the sheet stack transport path. To transport the sheet stack in the direction of arrow B in FIG. 1, the control block 149 activates the staple slide motor 42. This drive also moves the stopper abutting protrusion 24 on the drive head unit 31, as can be seen in FIG. 4 and in FIG. 5, to abut against the movement arm 23. The stopper is then retracted from the moving range of the drive head unit 31 and the anvil 32. The drive head unit 31 and the anvil unit 32 stop at a set position to drive in the direction traversing the sheet transport direction. Then, the control block 149 rotates the stepping motor 70 in a direction opposite to the non-staple mode and side staple mode. This drive moves the sheet stack in a direction opposite to the lifting tray 90 (the direction of arrow B in FIG. 1). When the stack sensor 54 in the folding unit 50 detects the leading edge of the sheet stack in the sheet transport direction through this movement, the transport upper roller 19 and transport lower roller 18 transport the sheet stack to a position that matches the stitching position at the center of the sheet stack in the sheet transport direction, and stop.

Note that when the stepping motor 70 rotates in the opposite direction, the one-way clutch 75 is interposed between the first pulley 10 and the first pulley shaft 10*a* around which the transport belt 12 is entrained. Therefore, when the stepping motor 70 rotates, the rotation is not transmitted and the transport belt 12 and pushing nail 13 remain stationary.

Next, the control block 149 activates the stapling/folding motor 170 to drive the head driving shaft 38 and anvil driving shaft 37 to perform the stitching operation. When the stitching operation is performed at a plurality of stitching positions, the stapler slide motor 42 is activated. The guide screw shafts 35 and 36 rotate to move the head assembly 31 and anvil assembly 32 to a predetermined position in a direction perpendicular to the sheet transport direction, and then the stitching operation is performed.

When the sheet stack is transported to the stitching position, the leading edge of the sheet stack passes the stack transport lower roller 52 and stack transport upper roller 51, separated therefrom, in the folding unit 50.

After the stitching operation is completed, the transport motor 162, shown in FIG. 8, is rotated in reverse and the upper roller movement arm 68, shown in FIG. 6 and FIG. 9, is rotated to perform the folding operation. This rotation moves the bearing holder 102 and lowers the stack transport upper roller 51 to the stack transport lower roller 52 side to nip the sheet stack with the tension spring 104.

Next, the transport upper roller 19 rises from the sheet stack to release the nip thereof. Now, the transport motor 162 is activated to rotate the stack transport upper roller 51 and stack transport lower roller 52 to transport the sheet stack further downstream. When transporting, using the information of the signals of the stack sensor 54 and sheet length, the transport motor 162 decelerates and then stops so that a center point of the sheet in the sheet transport direction, i.e. the stitching point, becomes the folding position. The sheet stack hangs into the transport path, and is nipped by the stack transport upper roller 51 and stack transport lower roller 52.

Then, the stapling/folding motor 170 rotates in a direction opposite to that for the stitching operation. As shown in FIG. 7(*b*), the folding rollers (57*a* and 57*b*) rotate in a direction to nip the sheet stack while the pushing plate 55 is lowered. In synchronization with this, the backup guides (59*a* and 59*b*) move to expose the circumferences of the folding rollers (57*a* and 57*b*) on the sheet stack side. After the pushing plate 55 moves to nip the sheet stack in the rotating folding rollers (57*a* and 57*b*), the sheet stack is caught and pulled into the folding rollers (57*a* and 57*b*). Then, the pushing plate 55 moves in a direction away from the sheet stack, and the sheet stack is folded further by the folding rollers (57*a* and 57*b*). The sheet stack transported in the state nipped between the folding rollers (57*a* and 57*b*) is then discharged into and stocked in the folded sheet stack discharge stacker 80. After the folding operation is started, the folding rollers (57*a* and 57*b*) stop when the pushing plate HP sensor detects the pushing plate 55 more than once. With the folded sheet pressure member 81 pressing the sheet stack, the folded sheet stack does not open and does not interfere with the transferring in of the next sheet stack.

Note that after the folding operation is started and the sheet stack is nipped between the folding rollers 57*a* and 57*b*, the stack transport upper roller 51 is raised and moves away from the stack transport lower roller 52 to be ready for the next sheet stack.

Also, the saddle-stitch mode according to the present invention shows a series of the operations of stitching and folding a sheet stack. It is also possible to employ only the folding operation without the stitching operation.

According to the sheet post-processing apparatus of the present invention, when it is started to fold the center of the sheets using the pushing operation with the sheet pushing member (pushing plate), both the first load means (the pair of stack transport rollers) and the second load means (a lever or rollers for holding sheets) apply loads to the upstream and downstream sides of the sheets. Also, when the sheet pushing member pushes the sheets, the sheets are nipped by the folding rotating bodies (the pair of folding rollers) so that the amount of tension applied to both the upstream and the downstream sides of the sheets is the same. Therefore, it is possible to precisely fold the sheets without any shift between the desired folding position and the actual folding position. Of particular note, it is adjusted so that the load applied by the first load means and the load applied by the second load means are equivalent, the actual amount of shift of the folding positions can be eliminated.

Also, with the image forming apparatus according to the present invention, it is possible to shift to a sheet post-process to enable the accurate and quick folding of the sheets from the previous process on the sheets performed by the storage means, sheet supply means and image forming means.

What is claimed is:

1. A sheet post-processing apparatus comprising:

stacking means for stacking at least one sheet;

transport means for transporting the sheet from the stacking means;

folding rotating members for folding the sheet by rotation in a state that the folding rotating members nip the sheet transported from the transport means;

a sheet pushing member for pushing the sheet transported by the transport means toward the folding rotating members by movement relative to the folding rotating members;

first load means for transferring the sheet and providing a load to the sheet when the sheet pushing member pushes the sheet by contacting the sheet at an upstream side of the folding rotating bodies in a direction that the transport means transports the sheet; and second load means for providing a load to the sheet when the sheet pushing member pushes the sheet by contacting the sheet at a downstream side of the folding rotating members in the direction that the transport means transports the sheet, said second load means being located lower than the first load means so that the second load means grips the sheet hanging downwardly from the first load means to thereby hold the sheet between the first and second load means.

2. A sheet post-processing apparatus according to claim 1, wherein said first load means applies the load substantially same as that of the second load means.

3. A sheet post-processing apparatus according to claim 1, further comprising support means for supporting at least one of the first load means and the second load means between a contact position contacting the sheet and a retracted position away from the sheet.

4. A sheet post-processing apparatus according to claim 3, further comprising control means for moving at least one of the first load means and the second load means from the retracted position to the contact position after the transport means stops transporting the sheet.

5. A sheet post-processing apparatus according to claim 3, further comprising control means for moving at least one of the first load means and the second load means from the contact position to the retracted position after the folding rotating members nip the sheet.

6. A sheet post-processing apparatus according to claim 3, further comprising interconnecting means for moving the second load means between the contact position and the retracted position according to a sheet pushing movement by the sheet pushing member.

7. A sheet post-processing apparatus according to claim 3, further comprising drive means for commonly driving at least two of the folding rotating members, the sheet pushing member, the first load means and the second load means.

8. A sheet post-processing apparatus according to claim 1, wherein at least one of said first load means and said second load means operates dually as the transport means.

9. An image forming apparatus in said sheet post-processing apparatus according to claim 1 comprising:

storage means for storing a sheet;

sheet supply means for supplying the sheet from the storage means one by one;

image forming means for forming an image on the sheet supplied from the sheet supply means; and.

10. A sheet post-processing apparatus comprising:

stacking means for stacking at least one sheet;

transport means for transporting the sheet from the stacking means;

folding rotating members for folding the sheet by rotation in a state that the folding rotating members nip the sheet transported from the transport means;

a sheet pushing member for pushing the sheet transported by the transport means toward the folding rotating members by movement relative to the folding rotating members;

first load means for applying a load to the sheet pushing member pushing the sheet by contacting the sheet at an upstream side of the folding rotating bodies in a direction that the transport means transports the sheet;

second load means for applying a load to the sheet pushing member pushing the sheet by contacting the sheet at a downstream side of the folding rotating members in the direction that the transport means transports the sheet;

support means for supporting at least one of the first load means and the second load means between a contact position contacting the sheet and a retracted position away from the sheet; and a guide member movable between a closed position for preventing the sheet pushed by the sheet pushing member from approaching the folding rotating members and an open position for allowing the sheet pushed by the sheet pushing member to approach the folding rotating bodies according to a movement of the sheet pushing member in pushing the sheet; said second load means being movable between the contact position and the retracted position according to a movement of the guide member.

11. A sheet post-processing apparatus according to claim 10, further comprising drive means for commonly driving at least two of the folding rotating members, the sheet pushing member, the first load means, the second load means and the guide member.

12. An image forming apparatus comprising:

storage means for storing a sheet;

sheet supply means for supplying the sheet from the storage means one by one;

image forming means for forming an image on the sheet supplied from the sheet supply means;

stacking means for stacking at least one sheet passing through the image forming means;

transport means for transporting the sheet from the stacking means;

folding rotating members for folding the sheet by rotation in a state that the folding rotating members nip the sheet transported from the transport means;

a sheet pushing member for pushing the sheet transported by the transport means toward the folding rotating members by movement relative to the folding rotating members;

first load means for applying a load to the sheet pushing member pushing the sheet by contacting the sheet at an upstream side of the folding rotating bodies in a direction that the transport means transports the sheet;

second load means for applying a load to the sheet pushing member pushing the sheet by contacting the sheet at a downstream side of the folding rotating members in the direction that the transport means transports the sheet;

support means for supporting at least one of the first load means and the second load means between a contact position contacting the sheet and a retracted position away from the sheet; and a guide member movable between a closed position for preventing the sheet pushed by the sheet pushing member from approaching the folding rotating members and an open position for allowing the sheet pushed by the sheet pushing member to approach the folding rotating bodies according to a movement of the sheet pushing member in pushing the sheet; said second load means being movable between the contact position and the retracted position according to a movement of the guide member.

13. An image forming apparatus according to claim 12, wherein said first load means applies the load substantially same as that of the second load means.

14. An image forming apparatus according to claim 12, further comprising control means for moving at least one of the first load means and the second load means from the retracted position to the contact position after the transport means stops transporting the sheet.

15. An image forming apparatus according to claim 12, further comprising control means for moving at least one of the first load means and the second load means from the contact position to the retracted position after the folding rotating members nip the sheet.

16. An image forming apparatus according to claim 12, further comprising interconnecting means for moving the second load means between the contact position and the retracted position according to a sheet pushing movement by the sheet pushing member.

17. An image forming apparatus according to claim 12, further comprising drive means for commonly driving at least two of the folding rotating members, the sheet pushing member, the first load means and the second load means.

18. An image forming apparatus according to claim 12, further comprising drive means for commonly driving at least two of the folding rotating members, the sheet pushing member, the first load means, the second load means and the guide member.

19. An image forming apparatus according to claim 12, wherein at least one of said first load means and said second load means operates dually as the transport means.

* * * * *